US010465896B2

(12) United States Patent
Van Winkle

(10) Patent No.: US 10,465,896 B2
(45) Date of Patent: Nov. 5, 2019

(54) LINKABLE LIGHTING SYSTEMS

(71) Applicant: ETi Solid State Lighting Inc., Wheeling, IL (US)

(72) Inventor: Gary Van Winkle, Chagrin Falls, OH (US)

(73) Assignee: ETi Solid State Lighting Inc., Wheeling, IL (US)

( * ) Notice: Subject to any disclaimer, the term of this patent is extended or adjusted under 35 U.S.C. 154(b) by 346 days.

(21) Appl. No.: 14/981,346

(22) Filed: Dec. 28, 2015

(65) Prior Publication Data

US 2017/0184284 A1 Jun. 29, 2017

(51) Int. Cl.

| | |
|---|---|
| ***F21V 29/70*** | (2015.01) |
| ***F21V 23/00*** | (2015.01) |
| ***F21V 23/04*** | (2006.01) |
| ***F21S 8/06*** | (2006.01) |
| ***F21V 23/06*** | (2006.01) |
| ***F21S 2/00*** | (2016.01) |
| ***F21S 4/28*** | (2016.01) |
| *F21Y 115/10* | (2016.01) |
| *F21Y 103/10* | (2016.01) |
| *F21W 131/40* | (2006.01) |
| *F21V 7/00* | (2006.01) |

(52) U.S. Cl.

CPC ..... *F21V 29/70* (2015.01); *F21S 2/00* (2013.01); *F21S 4/28* (2016.01); *F21S 8/061* (2013.01); *F21V 23/001* (2013.01); *F21V 23/04* (2013.01); *F21V 23/06* (2013.01); *F21V 7/005* (2013.01); *F21W 2131/40* (2013.01); *F21Y 2103/10* (2016.08); *F21Y 2115/10* (2016.08)

(58) Field of Classification Search

CPC ..... F21V 29/70; F21V 23/001; F21V 23/04; F21V 23/06; F21V 7/005; F21S 4/28; F21S 2/00; F21S 8/061; F21Y 2115/10; F21Y 2103/10; F21W 2131/40

See application file for complete search history.

(56) References Cited

U.S. PATENT DOCUMENTS

| | | | |
|---|---|---|---|
| 2,567,014 | A | 9/1951 | Fine et al. |
| 5,848,837 | A | 12/1998 | Gustafson |

(Continued)

FOREIGN PATENT DOCUMENTS

| | | | |
|---|---|---|---|
| CN | 201973532 | U * | 9/2011 |
| CN | 202511023 | U * | 10/2012 |
| CN | 202521318 | U * | 11/2012 |

OTHER PUBLICATIONS

Machine English Translation of CN202521318U Nov. 2012 Guojun Yan.*

(Continued)

*Primary Examiner* — Anh T Mai
*Assistant Examiner* — Glenn D Zimmerman
(74) *Attorney, Agent, or Firm* — Walter | Haverfield LLP; D. Peter Hochberg; Sean F. Mellino

(57) ABSTRACT

An LED linkable light system including LED light assemblies having LED light fixtures which are linkable together to enable linked individual LED lights to be turned on or off individually or together. Any number of LED linkable light fixtures can be linked together, and electricity is provided by a power cord being linked to one of the linked LED light fixtures and to a power source. The LED lamps are preferably LED shop lights or LED strip lights.

21 Claims, 15 Drawing Sheets

(56) References Cited

U.S. PATENT DOCUMENTS

| | | | |
|---|---|---|---|
| 6,283,612 | B1 | 9/2001 | Hunter |
| 6,536,924 | B2 | 3/2003 | Segretto |
| 6,860,628 | B2 | 3/2005 | Robertson et al. |
| 6,936,968 | B2 | 8/2005 | Cross et al. |
| 7,192,160 | B2 | 3/2007 | Reiff, Jr. et al. |
| 7,213,938 | B2 | 5/2007 | Brondt et al. |
| 7,438,441 | B2 | 10/2008 | Sun et al. |
| 7,441,922 | B2 | 10/2008 | Huang et al. |
| 7,476,004 | B2 | 1/2009 | Chan |
| 7,513,640 | B2 | 4/2009 | Hendrikus |
| 7,810,955 | B2 | 10/2010 | Stimac et al. |
| 7,997,770 | B1 | 8/2011 | Meurer |
| 8,308,324 | B2 | 11/2012 | Van Horn et al. |
| 8,531,109 | B2 | 9/2013 | Visser et al. |
| 8,714,772 | B1 | 5/2014 | Levante et al. |
| 8,882,298 | B2 | 11/2014 | Gershaw |
| 9,004,716 | B2 | 4/2015 | Ai |
| 2007/0127244 | A1 | 6/2007 | Cunius |
| 2008/0089069 | A1 | 4/2008 | Medendorp |
| 2009/0021936 | A1 | 1/2009 | Stimac et al. |
| 2009/0237922 | A1 | 9/2009 | Chiu |
| 2009/0296381 | A1 | 12/2009 | Dubord |
| 2010/0177511 | A1 | 7/2010 | Yu |
| 2010/0284195 | A1 | 11/2010 | Liu et al. |
| 2010/0295468 | A1* | 11/2010 | Pedersen ..... F21S 10/02 315/294 |
| 2012/0188756 | A1* | 7/2012 | Kokoski ..... F21L 14/023 362/217.05 |
| 2012/0300441 | A1 | 11/2012 | Thomas et al. |
| 2013/0182422 | A1 | 7/2013 | Guilmette |
| 2013/0343050 | A1 | 12/2013 | Hu |
| 2014/0177209 | A1 | 6/2014 | Carney et al. |
| 2014/0226320 | A1 | 8/2014 | Halliwell et al. |
| 2014/0226321 | A1 | 8/2014 | Halliwell et al. |
| 2014/0247585 | A1 | 9/2014 | Chien et al. |
| 2014/0355272 | A1 | 12/2014 | Chou |

OTHER PUBLICATIONS

Machine English Translation of CN201973532U Sep. 2011 Qiang Wang.*

Machine English Translation of CN202511023U; BangYang Fan (Year: 2012).*

Examiner's Report from the Canadian Intellectual Property Office dated Jan. 29, 2018 for corresponding Canadian Application No. 2,960,058.

* cited by examiner

FIG−9

LINKABLE LIGHTING SYSTEMS

BACKGROUND OF THE INVENTION

Field of the Invention

The present invention relates to linkable light emitting diode (LED) lighting fixtures and systems, and in particular to linkable shop light fixtures and systems, and linkable strip light fixtures and systems.

Description of the Prior Art

There are many light fixtures which are used for a variety of purposes including workshops, offices, factories, residences, schools and the like, which until fairly recently the market for such fixtures was largely filled with incandescent bulbs and fluorescent lights. A big problem with incandescent bulbs is that they convert most of their energy into heat as opposed to light, thus wasting electricity and generating unnecessary warmth. Fluorescent lighting generally involves ionizing a gas such as argon contained within a sealed tube. The electrically-excited gas produces light emission as the gas returns to its normal energy level. Although fluorescent lighting is widely used, it does have serious shortcomings. Fluorescent lighting is rather complex, and repairs can be costly both with respect to replacing ballasts and other components which may have to be replaced from time to time, and with respect to the high voltage that is needed for fluorescent lighting. The high voltage makes necessary added electrical insulation, and the requirement for safety precautions.

Compact fluorescent light bulbs have also become popular. Compact fluorescent lights, or CFLs convert most of their energy into light rather than heat. CFLs last longer than incandescent lights and are designed to fit into existing incandescent light fixtures. CFLs use about ¼ of the electricity required for incandescent bulbs while producing a comparable amount of light. While CFLs do not flicker when used for an extended period of time, they do have flickering problems if switched on and off frequently. Furthermore, the switching process takes more time than is desirable so that CFLs take a longer time to light before they become fully lit. Furthermore, CFLs require optimum temperatures to work and are known to function in less than their rated capacity when switched on in lower temperatures.

LEDs are becoming more and more popular. LEDs require lower power consumption than do CFLs.

A single LED is very small, but a combination of bunches of LEDs create powerful lights which can withstand more extreme conditions than ordinary bulbs. LEDs use about 1/50 of the energy of the standard incandescent bulbs, and last ten times longer than CFL alternatives. Indeed, LED bulbs can last up to fifteen years without needing to be changed. LEDs furthermore produce smaller amounts of heat than do CFLs, and the heat which is produced by LEDs is usually past back to a heat sink making them cool to the touch. With respect to energy efficiency, whereas a CFL uses less than fifteen watts and costs about $75.00 per year, an LED bulb of similar output would draw less than eight watts of power with an annual costs of $30.00 and last 50,000 hours or more.

There is also a disposal problem with CFL bulbs. CFL bulbs contain mercury which can evaporate and cause air and water pollution. Furthermore, mercury is a neurotoxin that can have a harmful effect on humans, particularly infants. Thus, disposal of CFLs and regular fluorescent bulbs can be a problem since they may break and release the mercury. They can thus be a problem for landfills and waste management workers, in addition to the environmental problems noted above.

The danger of CFLs is severe. The Environmental Protection Agency (EPA) has approved CFL recycling sites. Furthermore, the EPA recommends that in case a CFL breaks in a home, all members and pets are recommended to leave the room. The room has to be aired out for 10-15 minutes, the central forced air should be shut off, and the shards should be collected with stiff paper, tape or a damp paper towel, and then put in a glass jar with a metal lid or a sealable plastic bag and then taken to a recycling site. On the other hand, LED bulbs do not come with a mercury hazard, and most of them are recyclable.

There are other comparisons which indicate that LED bulbs are preferable over CFLs. CFLs require time after actuation in order for them to warm up to full capacity, whereas LED bulbs do not require any length of time to become active. CFLs may not work in temperatures that are less than −10° F. or greater than 100° F. whereas LED bulbs are not temperature sensitive. CFLs are not dimmable, whereas LED bulbs are dimmable. Although LED bulbs cost more than CFLs, the total cost of LED bulbs is less than the cost of CFLs during the life of the LEDs.

Thus, LED bulbs and LED light fixtures have been becoming more and more popular over time. In many instances, a single LED light fixture may be sufficient for such uses as in workshops. However, oftentimes a number of LED fixtures would be desirable. One could install a series of independent LED fixtures which need to be turned on and off as needed. This could be expensive, and could require a number of receptacles provided along the area which is to be illuminated. This concept has been addressed previously, but there are various shortcomings. Referring to U.S. Pat. No. 7,192,160, a set of fluorescent and/or LED light sources is shown having a control box for switching between two light sources is discussed. A series of lights can be electrically linked in series, and each light is provided with a control box so that the individual lights can be individually operated. This can be used in military barracks, wherein each soldier would be able to control his own light. However, this embodiment requires a series of control boxes, making the system expensive. Alternatively, the string of lights can have one control box in which all of the lights are operated in series. The first light in the series of lights is the master and the remaining lights that are connected are slave lights. Thus, all of the lights must be operated together, rather than one at a time.

Another light tube system is disclosed in U.S. Pat. No. 7,513,640. Light tube system can have a number of light tube units which are connected together by cables. The cables have connector pins which extend in a direction perpendicular to the longitudinal direction of the light tubes, making it awkward to connect them together. There is no indication in the '640 patent as to where the on-off switch is located. The light tubes discussed in this patent appear to be fluorescent tubes, and thus have all of the shortcomings of fluorescent bulbs discussed above.

In U.S. Pat. No. 9,004,716, a set of LED tubes are connected together by adaptors so that the tubes extend in a collinear direction. The adaptors include an adaptor main body and rotational fittings. A shortcoming of the disclosure of this patent is that the LED tubes must be fixed in a certain position, and no variation of the position is possible. There is also no device for hanging the assemblies at their opposite ends.

In U.S. Publication No. 2012/0188756, another master/slave LED work light is disclosed. The work light has a power cord that extends entirely through the work light for connecting the work lights together. A master/slave LED work light lighting network and remotely controlled lighting network is disclosed. There is a master light and a number of slave lights that are controlled by the master light. This means that the individual lights cannot be controlled separately. This arrangement has a serious shortcoming if the lighting apparatus is to be used in an area where the lights in the string need to be turned on or off depending on the current situation.

Another type of LED lamps are referred to as strip lights. Strip lights are conventionally flexible strips on which LEDs are mounted, and the flexible strips usually come with an adhesive backing so that they can be attached to walls, fixtures and the like. LED strip lights are sometimes referred to as LED tapes or ribbon lights. Strip lights can be water resistant, and if so they can be used for both indoor and outdoor lighting. Strip lighting is often used for colors other than white. All LED strip lights require a driver and generally operate on a 12 or 24 volt direct current from the driver.

However, strip lighting is often used for such areas as workbench lighting and also for office lighting and artistic lighting. When used with a workbench, strip lighting can be used to eliminate shadows that would often occur with behind the shoulder lighting. LED strip lighting can also be used to eliminate shadows. LED strip lighting also finds use with desks such as with use with a monitor, preferably not being used in a dark room or with strong lights which can cause screen glare. The use of an LED strip light behind the monitor can create a gradual shift between the brightness of the monitor and the light in the rest of the room to reduce eye strain. LED strip lighting can be used in artists' studios to avoid harsh or bright lights which are close to natural light.

U.S. Pat. No. 6,283,612 discloses an LED light strip and incorporates an array of solid state LEDs inside of a transparent or translucent tube. A single power supply can energize up to 350 LEDs in the white configuration. The light strip disclosed in this patent finds particular use in lighting candy displays in stores and markets. The strip light disclosed in this patent has a solidly mounted circuit board held in the tube firmly so that it is vibration resistant. A pair of end caps are located at opposite ends of the tube to plug each end, and a wire penetrates the cap and is potted or sealed so as to make the light waterproof. The light strip includes an electrical cable connected to busses on a single end or on both ends of the light, and a male or female connector can be incorporated. One embodiment of the LED light strip disclosed in the latter patent is said to enable the attachment of a number of light strips together by means of an electric cable and connector for attaching the busses together to prepare for a parallel connection between light strips so that they can be connected together limited only by the ability of the power supply. The individual LED light strips cannot operate separately and must therefore be used on and off together. There is no indication that the light strip set forth in the foregoing patent for anything other than illuminating displays and not in various work areas.

BRIEF SUMMARY OF THE INVENTION

An object of the present invention is to provide an economical lighting assembly for use in a single location but which can be expanded to multiple locations.

Another object of the present invention is to provide an economical lighting system which uses low power in comparison to systems having incandescent bulbs or fluorescent bulbs, and which can be used in workplaces or the like in one or a series of locations.

It is yet another object of the present invention is the provision of a lighting system using low power as compared to incandescent or fluorescent lighting systems, incorporating LED arrays in translucent or transparent light transmitting lamps wherein the lamps can be selectively connected together for various lengths for generating illumination either collectively or individually.

It is still another object of the present invention to provide LED light assemblies which can easily be connected together to expand the area of the illumination, and which can easily be disconnected if desired.

It is also an object of the present invention to provide an easily installable shop light system whose area of illumination can be changed using an easy to use connection for linking respective LED lighting assemblies together.

Another object of the present invention is to provide linkable lighting fixtures which can be easily and compactly stored, and manually installed for use.

A further object of the present invention is to provide an assembly of LED shop lights which can be connected together by a flexible linking cable having connectors at either end for simple, yet effective connection to shop lights that are to be linked together.

A still further object of the present is to provide linkable LED shop lights, when linked together, can be operated individually.

An additional object of the present invention is to provide LED strip lights which can be linked together to expand their areas of illumination.

A related object of the present invention is to provide a linkable LED strip light system in which individual strip light fixtures can easily be linked together and unlinked from each other.

Another additional object of the present invention is to provide a linkable LED strip light system in which the LED strip lights, when linked together, can be individually or simultaneously operated.

A still further object of the present invention is to provide an LED shop light system which is efficient, effective and easy to use.

A still additional object of the present invention is to provide a linkable LED strip light linkable system which is easy to use, easy to operate and efficient in operation.

These and other objects will be apparent to those of ordinary skill in the art from the description to follow and from the appended claims.

The foregoing objects are achieved according to the preferred embodiments of the invention. Referring to the first embodiment, it incorporates shop lights. An important feature of the inventive shop light system is that two or more inventive shop lights can be easily linked together. Each LED shop light fixture incorporates an LED shop light lamp which is attached to a metal cover, the LED shop light lamp incorporates a power component, a heat sink and an LED module which in turn includes an array of LEDs which are electrically connected by a printed circuit board. The LED shop light lamp further includes a heat sink for absorbing heat generated by the LEDs and a diffuser for spreading the light out to the space to be illuminated. The LED shop light lamp is seated beneath the metal cover, and a pair of end caps connect the LED shop light lamp to the metal cover. The end caps have receptacles for receiving either a linking plug of a linking connector in the form of a linking cable, an electrical input plug of a power cable, the other end of the power cable including an outlet plug for insertion into an electrical outlet, or a protective cap. The linking cable and the power cable are sometimes referred to herein as electrical transmitting lines. The preferred embodiment further includes suspension structure such as chains which can be secured to a ceiling so that the metal cover with the components of the LED shop light fixture attached thereto can be suspended from the ceiling. A light switch is provided for energizing or de-energizing the respective LED shop light lamps individually. The linking cable noted above can be used to connect one or more like inventive LED shop light lamps together.

Another preferred embodiment of the invention relates to linkable LED strip lights. The linkable LED strip light is replaceable and fits in a cover forming part of a linkable LED strip light fixture. Each linkable LED strip light fixture has an elongated housing in which is disposed a driver located inside a driver box top and a driver box bottom, and a power plug is electrically connected to the driver. A heat sink is disposed above an LED module. The LED module includes an array of LEDs and a mounted circuit board for electrically connecting the LED arrays together into a circuit. At each end of the housing, an end member is provided which is inserted into an opening at the opposite ends of the housing. The end member has receptacles for receiving alternatively a protective cap, a linking plug or a rigid connector. The lower part of the housing, when the housing is in use, is an elongated diffuser for diffusing light emitted by LED strip lights. The LED strip lights can be linked together by means of either a linking cable or a rigid connector.

As used herein, an LED shop light system refers to two more shop light assemblies that can be linked together according to an aspect of the inventions, and an LED shop light assembly refers to a single LED shop light fixture that is linkable to a compatible LED shop light assembly. An LED shop light fixture incorporates an LED shop light lamp for illumination. Likewise, an LED strip light system, refers to two or more strip light assemblies that can be linked together, can an LED strip light assembly refers to a single LED strip light fixture that is linkable to a compatible LED strip light assembly. An LED strip light fixture has one or more strip light lamps for illumination.

BRIEF DESCRIPTION OF THE DRAWINGS

Objects and advantages together with the operation of the invention, may be better understood by reference to the following detailed description taken in connection with the following illustrations, wherein.

DETAILED DESCRIPTION OF THE PREFERRED EMBODIMENT

Figure 1:
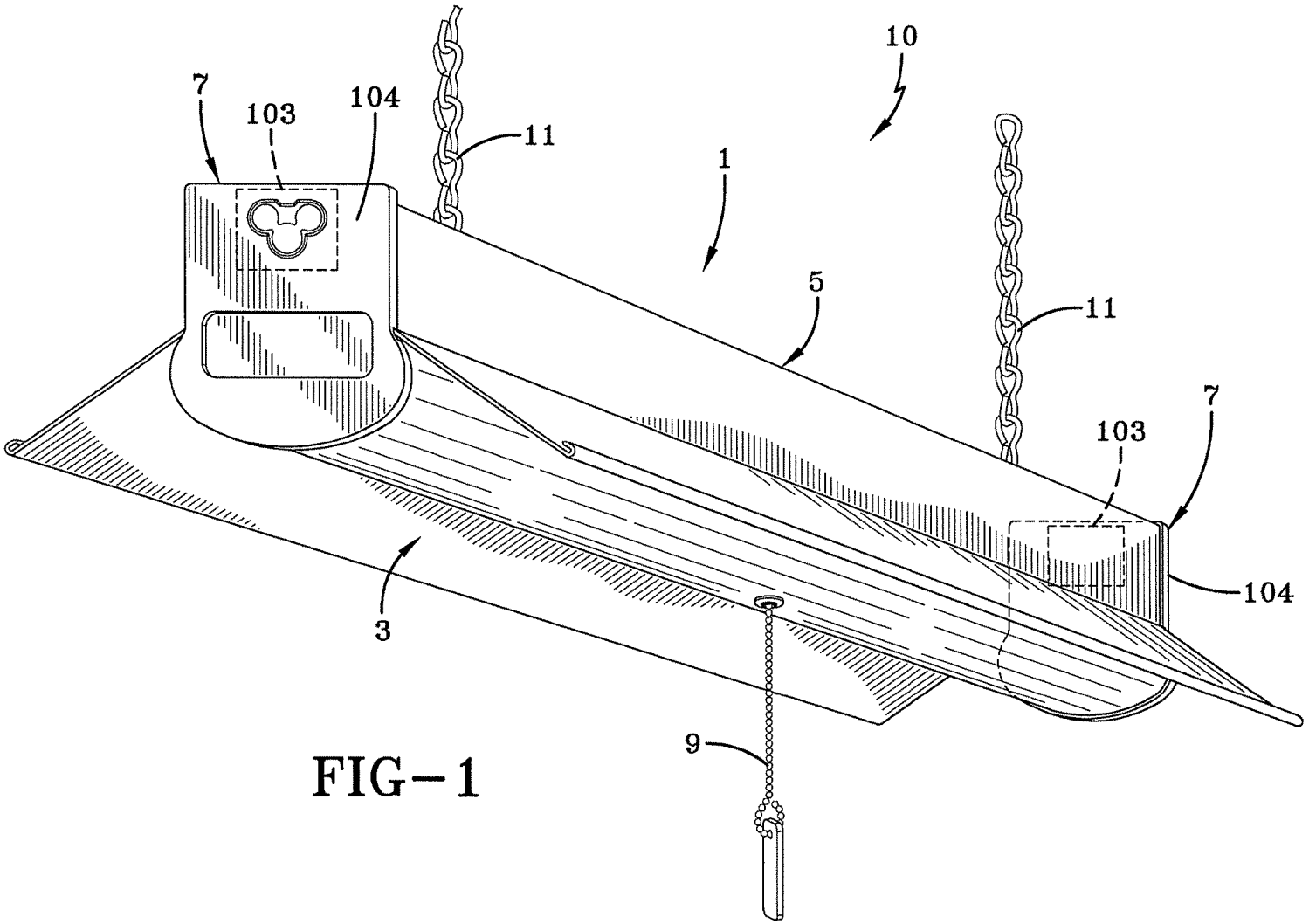
FIG. 1 is a perspective view of an LED shop light assembly according to a preferred embodiment of the invention, suspended from metal chains.
Figure 2:
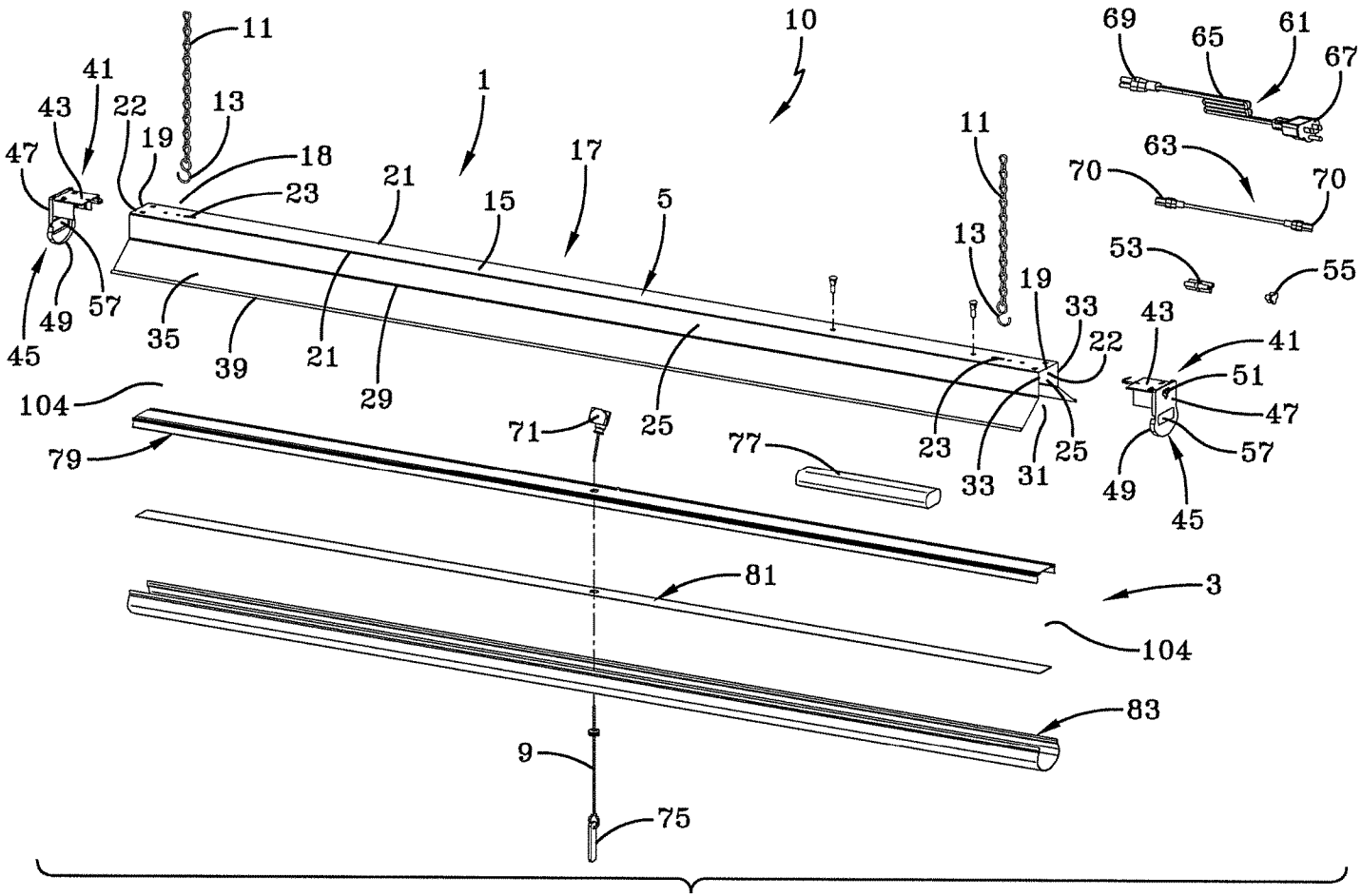
FIG. 2 is an exploded view of some of the components of the LED shop light assembly shown in FIG. 1.

One of the preferred embodiments of the present invention is an elongated linkable LED shop light fixture 1 as shown in perspective in FIG. 1. LED shop light fixture 1 includes an LED shop light lamp 3, a cover 5 which is preferably made from metal such as aluminum, a cap assembly 7 (there is a cap assembly 7 at either end of cover 5), an on-off chain 9 which is preferably made from an appropriate steel or aluminum and, to form an LED shop light assembly 10 (which has other components) a pair of suspension chains 11, which can be made from an appropriate metal such as steel or aluminum from which LED shop light fixture 1 would be suspended. On-off chain 9 is a chain for controlling an on-off switch. An exploded view of linkable LED shop light fixture 1 and shop light assembly 10 are shown in FIG. 2. Cover 5 can be hooked on suspension chains 11 which would be held fast by a sealing or other upper support structure. Suspension chains 11 have at their respective bottoms a hook 13 for extending through two pairs of chain-holding holes 23 in a rectangular top wall 15 of cover 5.

Cover 5 includes a five sided shade 17 having rectangular top wall 15 which has opposing straight opposing parallel end edges 19, parallel opposing straight longitudinal edges 21. Shade 17 also has opposite shade end portions 18. Cover 5 further comprises a pair of identical opposing rectangular side walls 25. Side walls 25 have a first pair of opposing parallel longitudinal edges which are connected to and from common longitudinal edges 21 of top wall 15. Side walls 25 further have a second pair of opposing parallel longitudinal edges 29 spaced from said first pair of opposing longitudinal edges 21. Rectangular top wall 15 and opposing rectangular side walls 25 forming a three sided cavity 31 in the form of a parallelepiped having an open bottom. Cavity 31 is defined at its end by upper end edge which is coincident with straight opposing parallel end edges 19 of top wall 15 and opposing parallel side edges 33 which are also the end edges of side walls 25.

Cover 5 has opposing identical rectangular side flange walls 35. Each flange wall 35 has a pair of parallel longitudinal edges that are the same as the second pair of opposing parallel longitudinal edges 29 of respective side walls 25 and also identified by numeral 29, and a second pair of opposing parallel longitudinal free edges 39. Side flange walls 35 are inclined by equal amounts from parallel rectangular side walls 25 and are symmetrical therewith.

A pair of opposing identical end caps 41 which cooperate with cover 5 to close the ends of three sided cavity 31. Each end cap 41 comprises an upper flat plate 43 having a width equal to the distance between longitudinal edges 21 of rectangular top wall 15 so that upper flat plate 43 can rest against the underside of top wall 15. Upper flat plate 43 is preferably attached to top wall 15 by means of a single screw with a lock washer, and a pair of resilient tabs (which are plastic when upper flat plate 43 is plastic) for extending through holes near end of top wall 15. End cap 41 further includes an end cover 45 which is flat and extends downwardly from upper flat plate 43 and has an upper rectangular cover portion 47 which closes the respective open ends of three-sided cavity 31, and a lower partially-circular portion 49 having a curved portion for covering the end of LED shop light lamp 3 installed within cover 5 as discussed below. Electrical connection to LED shop light lamp 3 is preferably made by two pairs of electrical conducting wires extending from a driver discussed below and extending respectively to end caps 41. The electrical conducting wires are attached to a pair of electrically insulated tubes or tubular prongs forming a part of respective end caps 41 which are lined with an electrical conducting tubular sleeve which extend beyond the free end of the prongs and are engageable as discussed below. A third tubular prong also has an electrical conducting tubular sleeve extending beyond the free end which is connected to an electrical conducting sheet metal grounding plate attached to each of end caps 41. The foregoing conducting members are preferably copper. Electrical connection is made by electrical contact with the extensions of the conducting tubular sleeves, but other forms of electrical connection fall within the scope of the invention. The three prongs with their conducting sleeves are designated broadly as LED lamp electrical contacting structure. End cap 41 include a linking orifice 51 preferably having having the shape of three overlapping circles or a trefoil forming the end of three overlapping cylinders for providing access for receiving an electrical input plug 69, a linking plug 70, a linking connector 53 or a protective cap 55. The foregoing three prongs are disposed in the last-mentioned partial cylinders. The foregoing three prongs are fixed in and a part of each end cap 41. End cap 41 has a recess having the same trefoil configuration as does linking connector 53, wherefore protective cap 55 can cover the foregoing recess for protective purposes. End cover 45 further can have a manufacturer's designation (brand name, trademark, etc.) located at area 57.

LED shop light assembly 10 includes LED shop light fixture 1, suspension chains 11 and the cables as further presently explained. A power cable 61 and a linking cable 63 are both shown in FIG. 2. Power cable 61 includes an insulated electrical line 65, an outlet plug 67 and an electrical input plug 69 at the opposite ends of electrical line 65. Electrical input plug 69 has three equiangularly-spaced prong receptacles for receiving three electrical prongs from LED shop light lamp 3. The prong receptacles of each of each output plug, each electrical input plug and each linking connector described herein have diameters to receive the LED lamp prongs in a snug relation. Three prongs of electrical input plug 69 are tubular and have copper (or other electrical conducting) tubular sleeves arranged to make contact with the extensions of the copper sleeves in the prongs of each end cap 41. Each of the linking devices, i.e. linking connector 53, electrical input plug 69, and linking plug 70 must have appropriate electrically conductor construction to operatively connect with the LED lamp contacting structure. The foregoing electrically conductive construction are referred to herein as linking electrically contacting structure. Each of linking connector 53, electric input plug 69 and linking plug 70 has three merged plastic tubes with copper or other electrical conducting sleeves, which when inserted into linking orifice 51 of LED shop lamp 3, effects an electrical conducting transmission line with LED shop lamp 3. This is because the electrical conducting sleeves of the respective linking devices are an example of the linking electrically contacting structure which cooperate with the LED lamp electrically contacting structure to establish an electric transmitting structure to transmit electricity between the respective plug and linking connector to another LED lamp or from a power outlet to the respective LED lamp. Power cable 61 is used to supply electric power to LED shop light fixture 1, and is accomplished by inserting the prongs of outlet plug 67 in an ordinary wall socket and by inserting electrical input plug 69 into one of linking orifices 51 of end cap 41. Electrical conducting wires from the tubular prongs are connected to a driver 77 discussed below. Linking cable 63 is used to link or connect a pair of LED shop light fixtures 1 together so that each of the linked-together shop light fixtures 1 can be operated together or individually, so long as power cable 61 is inserted in an electrical outlet and in linking orifice 51 in an end of the linked together shop light fixtures 1. Linking cable 63 has linking plugs 70 at its opposite ends, and linking plugs 70 of a linking cable 63 can easily be inserted in linking orifice 51 of adjacent shop light fixtures 1 so that the linked in shop light fixtures 1 can be operated together.

In order to activate LED shop light lamp 3 held within cover 5, a switch 71 is provided. Switch 71 is included in the electrical circuit that includes the foregoing lamp 3 as discussed hereinafter. On-off chain 9 is attached to switch 71, and it includes tags 75 for identifying shop light fixture 1.

Figure 6:
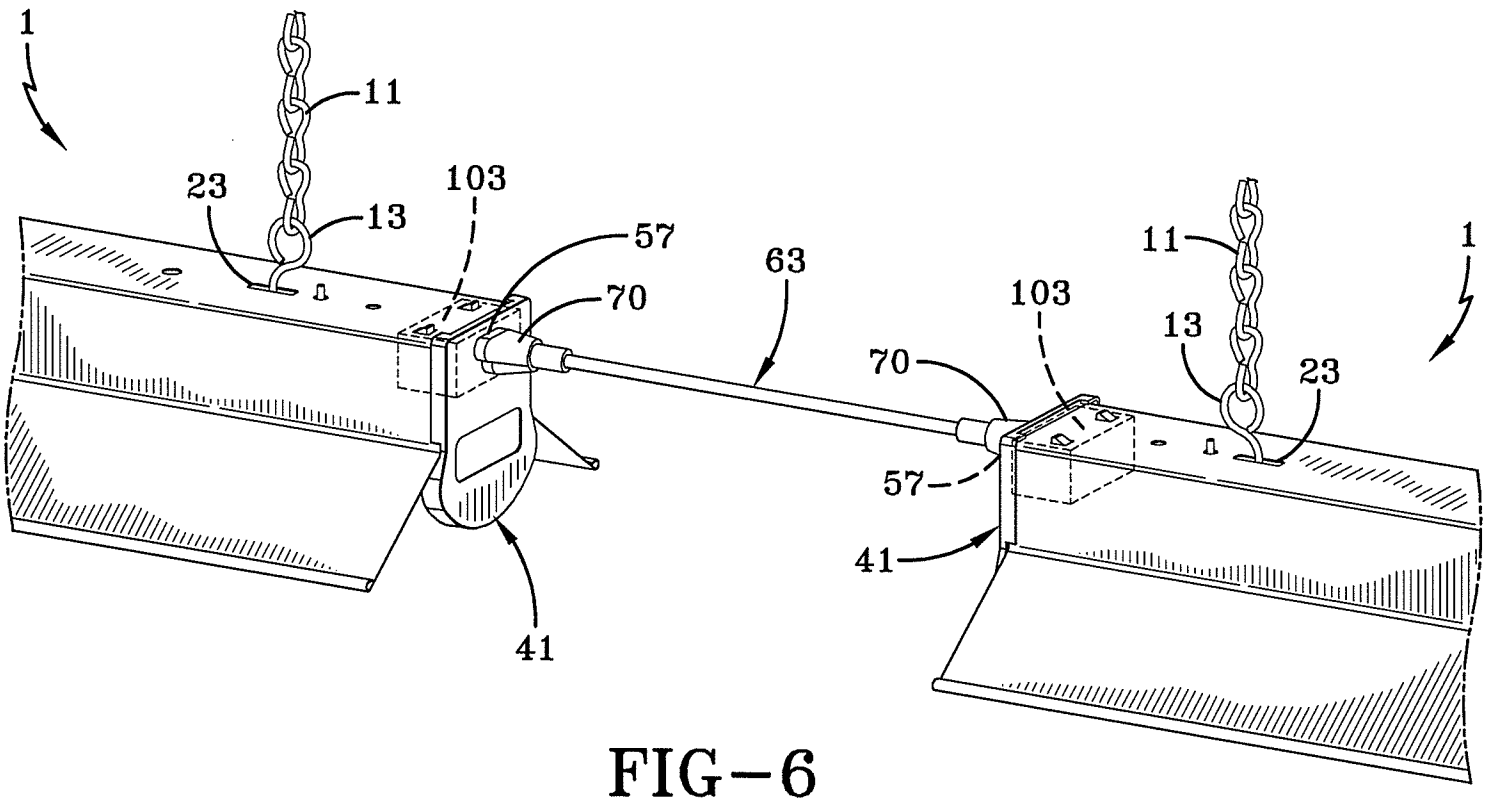
FIG. 6 is a partial perspective view of an LED shop light system incorporating a pair of LED shop light bulb assemblies of the type incorporated in the LED shop light assembly shown in FIG. 2, connected together by a linking cable.

LED shop light lamp 3 includes driver 77, a heat sink 79, an LED module 81, diffuser 83, and prongs, three in number (or other electrically contacting structure) for transmitting electrical current to lamp 3. Driver 77 is used to transmit power to LED shop light lamp 3 when lamp 3 assembled in cover 5. Electrical conducting wires are connected to both driver 77 and the printed circuit included in LED module 81. Heat sink 79 is provided for absorbing and transmitting heat generated by LED shop light lamp 3 when the latter is illuminated. LED module 81 is provided adjacent heat sink 79. LED module 81 comprises LED chips that are mounted on printed circuit boards that use surface-mounted technology. Finally, diffuser 83 is provided for containing driver 77, heat sink 79 and LED module 81. Diffuser 83 spreads the illumination from LED module 81 in a desired pattern, which essentially directs most of the illumination downwardly to the space to be illuminated. LED shop light lamp 3 further includes end connectors 103 shown in FIGS. 1 and 6 schematically (but which can be of any appropriate type including those in the known art) at LED shop light lamp end portion 104 through which electrical connection can be made with LED shop light lamp 3.

Figure 3:
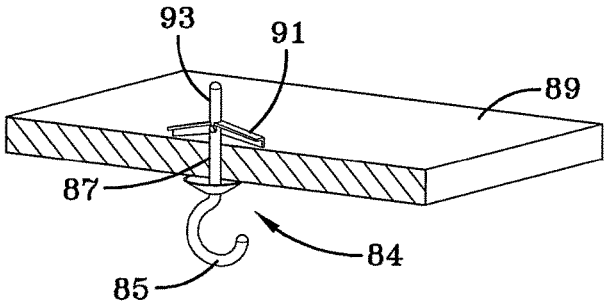
FIGS. 3-5 show components of an LED shop light assembly according to a preferred embodiment of the invention being installed from on a drywall and from a ceiling.
Figure 4:
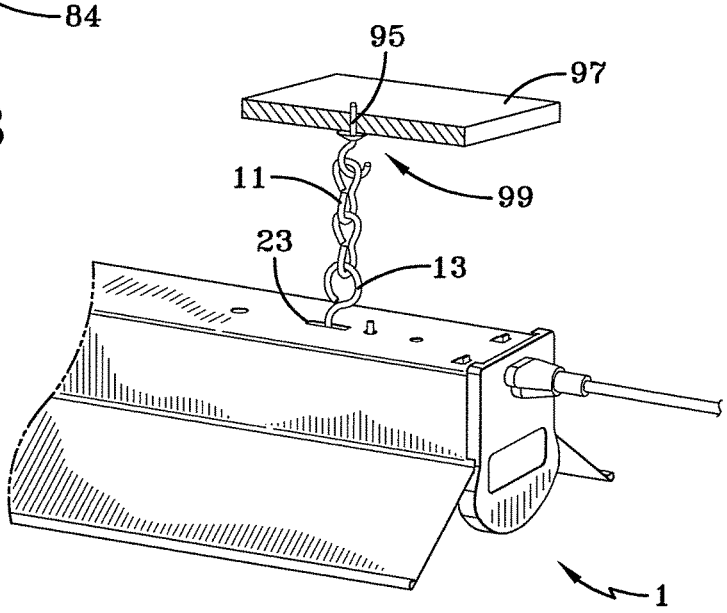
Figure 5:
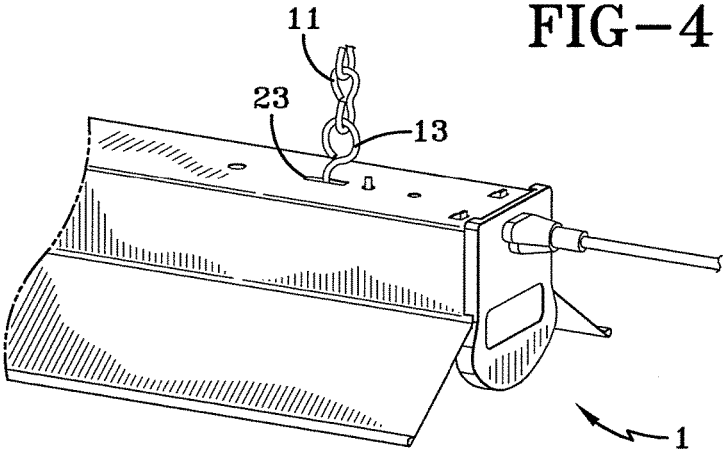

Linkable LED shop light fixture 1 is very easy to install. In order to install shop light fixture 1 to a drywall ceiling 89 as shown in FIG. 3, the installer uses a toggle bolt 84 with a toggle bolt hook 85. A small hole 87, which should be around ¼", is drilled in drywall ceiling 89. The installer inserts a bolt 93 through hole 87 with a pair of flaps 91 in a folded position until flaps 91 are on the upper part of drywall ceiling 89, at which time they open up as shown in FIG. 3. Toggle bolt 93 is then tightened. If a wood ceiling is used, the installer would drill a small hole 95 into a wood ceiling 97 as illustrated in FIG. 4 and install a bolt hook 99 therein. In either case, hook 13 at the lower, free end of suspension chains 11, is inserted through each pair of chain holding holes 23 as shown in FIGS. 4 and 5. In this manner, shop light fixture 1 is easily installed in either of ceilings 89 or 97.

There are two ways in which adjacent linkable LED shop light fixtures 1 can be linked together to form an LED shop light system 100. With reference to FIG. 6, linking cable 63 is used to link together shop light assemblies 1. It can be seen that the two linking plugs 70 are inserted in linking orifice 51 (shown in FIG. 2) extending though the respective end caps 41 at the adjacent ends of shop light assemblies 1. Linking cable 63 is flexible, and shop light assemblies 1 do not have to be in alignment as they are shown, but could be at an angle relative to each other could be at different distances from the ceiling and need not be parallel to each other. Furthermore, linking cable 63 can be held taut as shown in FIG. 6, but can also have some slack in it as well.

Figure 20:
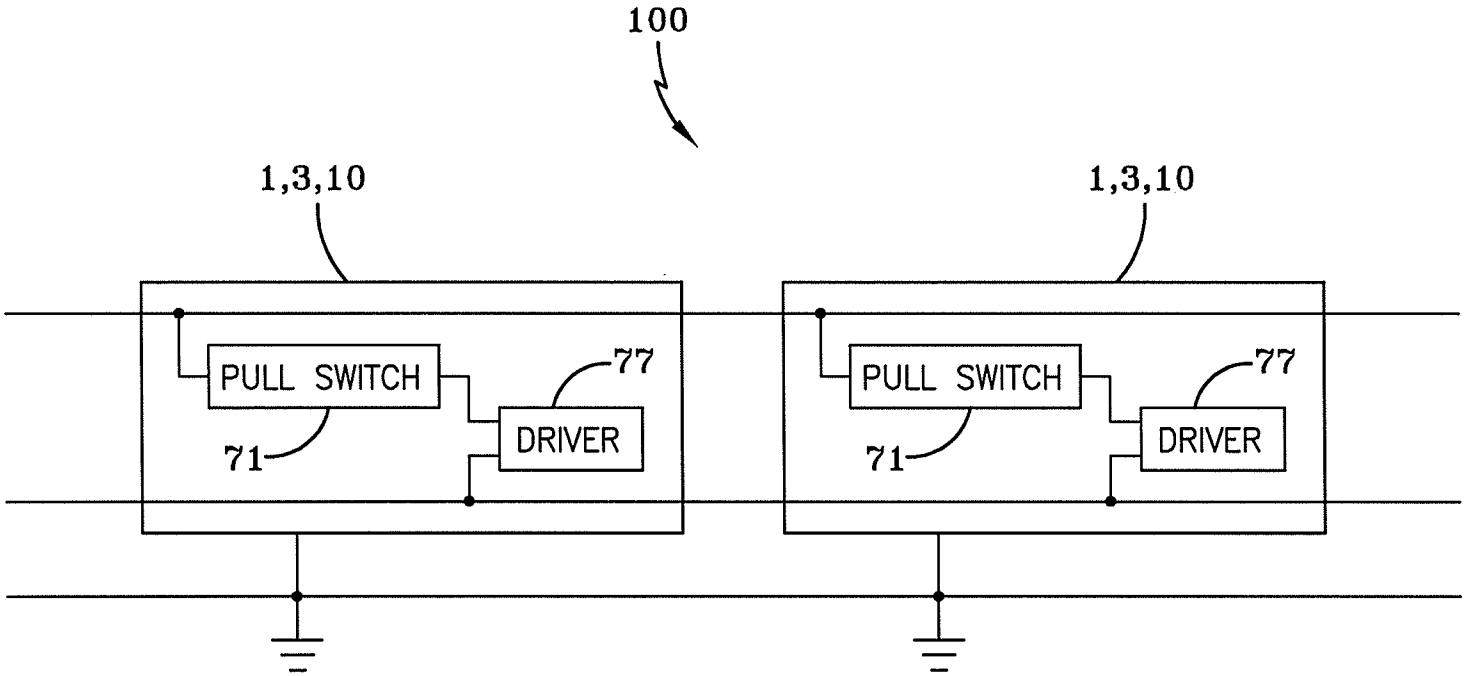
FIG. 20 is an electric circuit diagram showing the switching arrangement for an LED shop light system according to a preferred embodiment of the invention.

Reference is made to FIG. 20 showing the electrical connection of a pair of LED shop light lamps 3 in shop light fixtures 1 of LED shop light assemblies 10 to form an LED shop light system 100. Two LED shop light lamps 3 in shop light fixtures 3 are linked together. Switch 71 is connected in series with driver 77 in each of the pair of linked fixtures 1 with LED shop light lamps 3. Each circuit is connected to ground. Each LED shop light lamp 3 has a pull switch 71 for operating driver 77 or for deactivating driver 77. Each pull switch 71 can thus be operated to activate the respective LED lamps 3 to turn them on or off.

Figure 7:
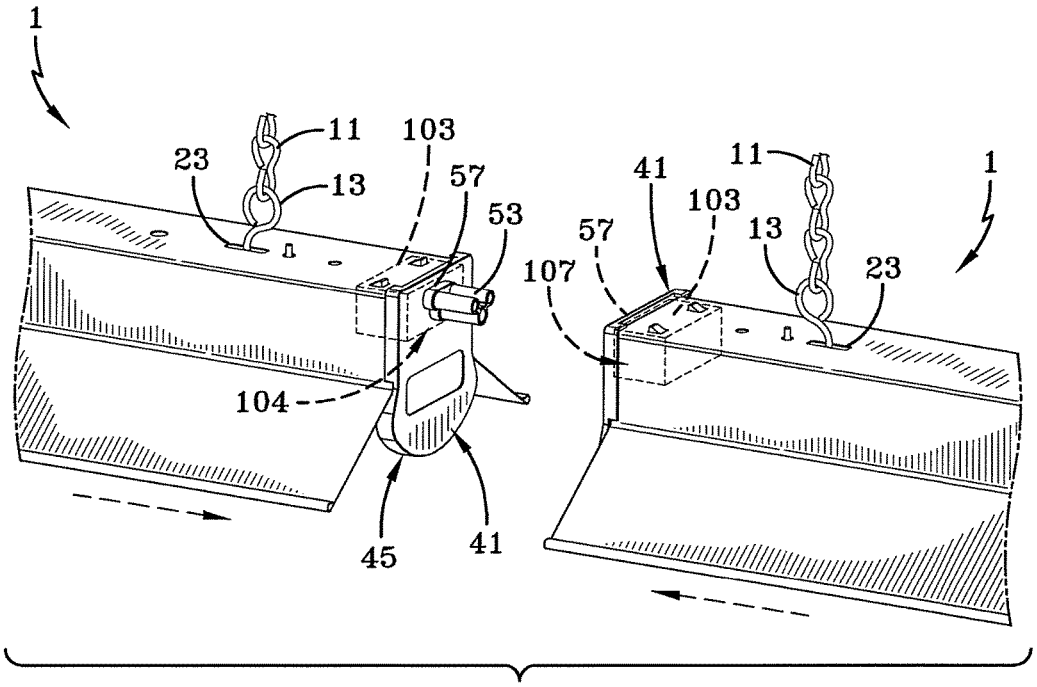
FIGS. 7 and 7A are partial perspective views of an LED shop light system composed of a pair of LED shop light assemblies about to be and then connected together by a rigid connector.
Figure 7A:
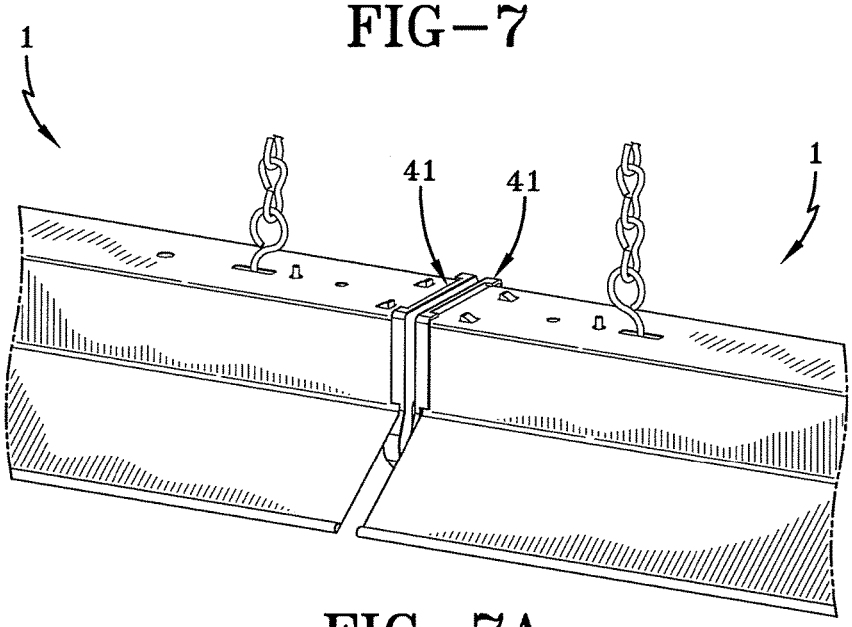

Referring to FIGS. 7 and 7*a*, linking connector 53, which is preferably rigid, is shown installed into linking orifice 51 of one shop light assembly 1 and positioned for insertion into linking orifice 51 in the adjacent shop light assembly 1. Once linking connector 53 is installed in both linking orifices 51 and shop light assemblies 1 are urged together as shown in FIG. 7*a*, shop light assemblies 1 are firmly connected together as shown in FIG. 7*a*, and their respective end piece covers 45 either engage each other or are very close to such engaging. Linking connectors 53 could be long, yet still make the electrical connection with each. Linking connector 53 is preferably short, about an inch and a quarter (1¼ inches) in length, but it could be of any length. It is preferably symmetrical at both ends, and has prong receptacles at both ends having copper or other electrical conducting tubular sleeves for receiving the respective prongs from each of a pair of LED lamps. The sleeves contact the tubular extensions of the tubular sleeves in end cap 41. When the LED lamps have three prongs equiangularly-spaced on the ends of the respective LED lamps, the prong receptacles of each linking connector are likewise equiangularly-spaced to receive the LED lamp prongs. As can be seen in FIGS. 2 and 7, linking connector 53 is composed of three merged tubes. The tubes have copper or other electrical conducting tubular sleeves. At either ends, the tubes having cylindrical holes forming the prong receptacles. The prong receptacles have a trefoil orientation. Linking connector 53 has a thickened band at its midsection which acts as a shoulder for engaging the surface around linking orifice 51 to limit the insertion of linking connector 53 into end cap 41.

Any number of shop light assemblies 1 can be linked together using either linking cables 63 or linking connectors 53. One power cable 61 is required in order to energize a single shop light assembly 1 or a series of shop light assemblies 1 that are linked together. Each of a set of linked together shop light assemblies 1 can be operated independently by means of the actuation of switch 71 by means of chain 73 by simply pulling chain 73 to turn the respective shop light assemblies 1 on and off.

Figure 8:
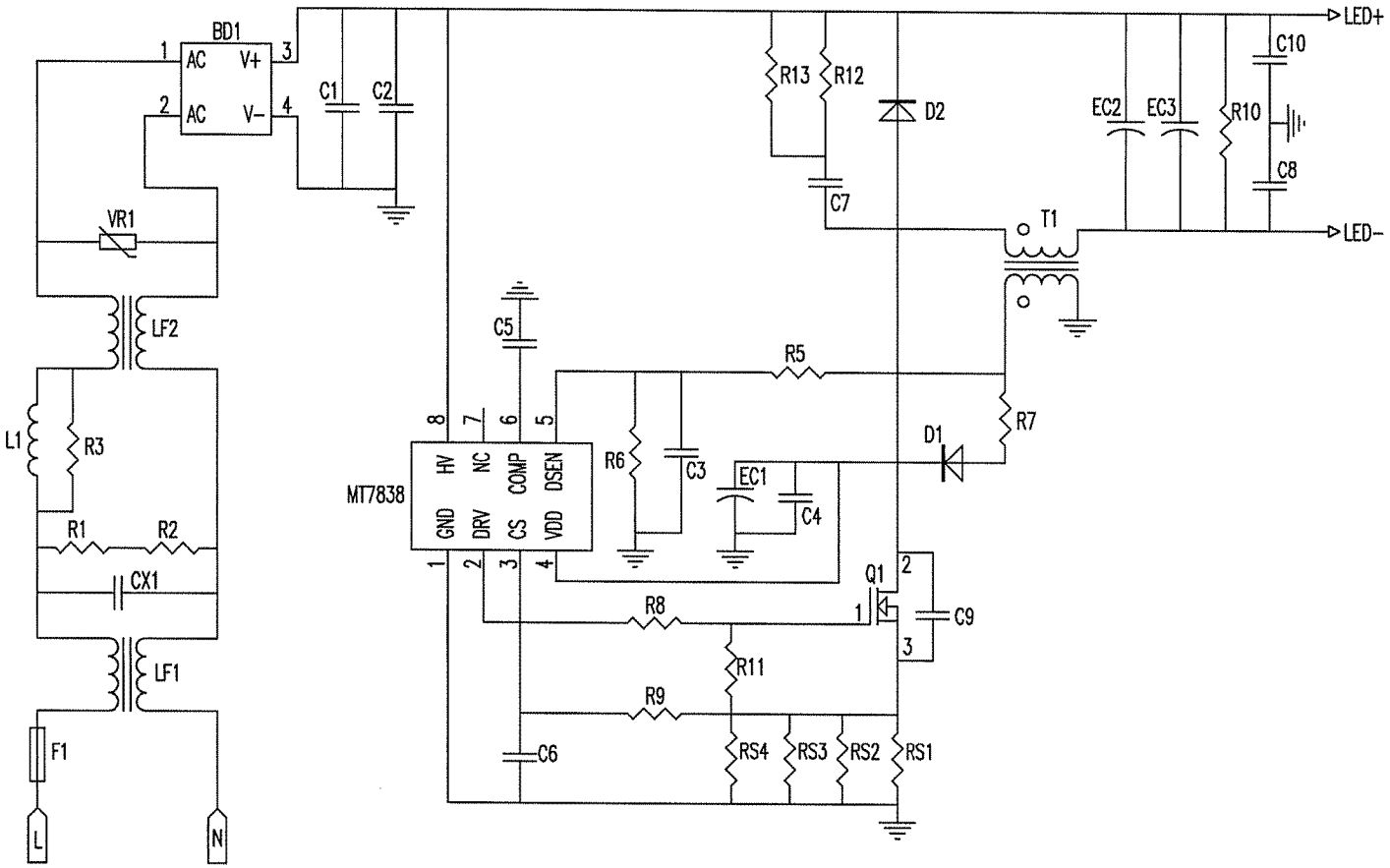
FIG. 8 is a circuit diagram of the electrical components for use in the LED shop light fixture shown in the preceding figures.

A circuit diagram 101 for shop light assembly 1 is shown in FIG. 8. There is a pair of inputs L and N with a fuse F1 in series with input L which are connected to a transformer LF1 to which is connected a circuit component including a capacitor CX1 which is parallel with resisters R1 and R2. Also in this circuit component is an inductor L1 connected in parallel with a resister R3. Another transformer LF2 is connected to a circuit component having a variable resister VR1 which is in turn connected to an AC/DC converter BD1. The output of the latter, V+ and V-connected across a pair of capacitors C1 and C2. These are in turn connected to a circuit having a control component. Components C1-C10 are capacitors. D1 and D2 are diodes. The component labelled MT7838 is a single-stage buck average constant current controller. T1 is a transformer which is connected to the ground. BD1 is a current compressor and VR1 is a voltage reducer. The bridge having capacitors C1 and C2 are connected to ground, as are capacitor C5 and the circuit including RS1-RS4, C6 and R9. EC1-EC4 are polarized capacitors.

Figure 9:
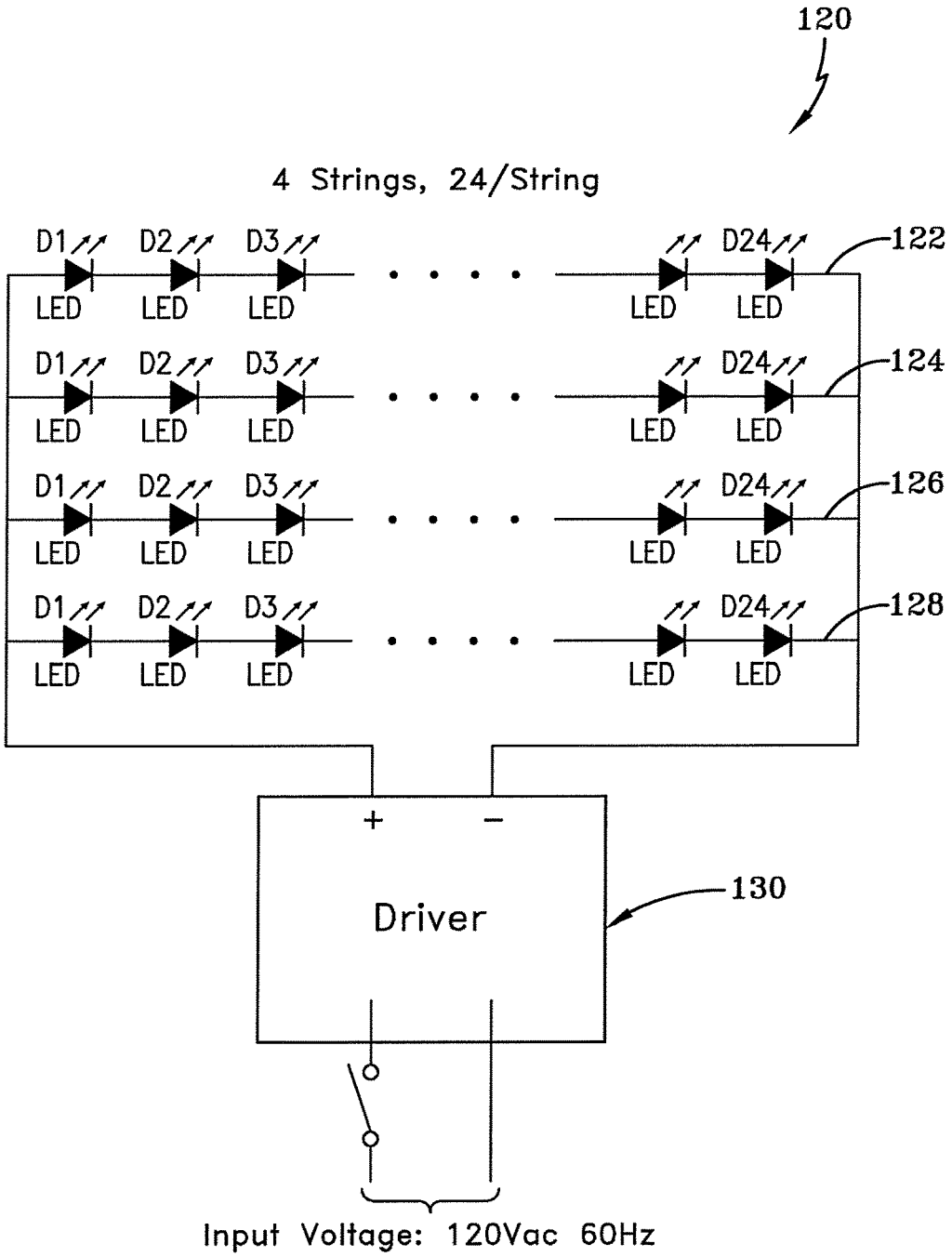
FIG. 9 is a circuit diagram for the electrical components of a LED shop light bulb shown in the preceding figures with a driver.

Referring to FIG. 9, an LED strip circuit 120 is shown. Strip circuit 120 has four strings 122, 124, 126 and 128, each having twenty four LEDs. These are powered by a driver 130.

Figure 10:
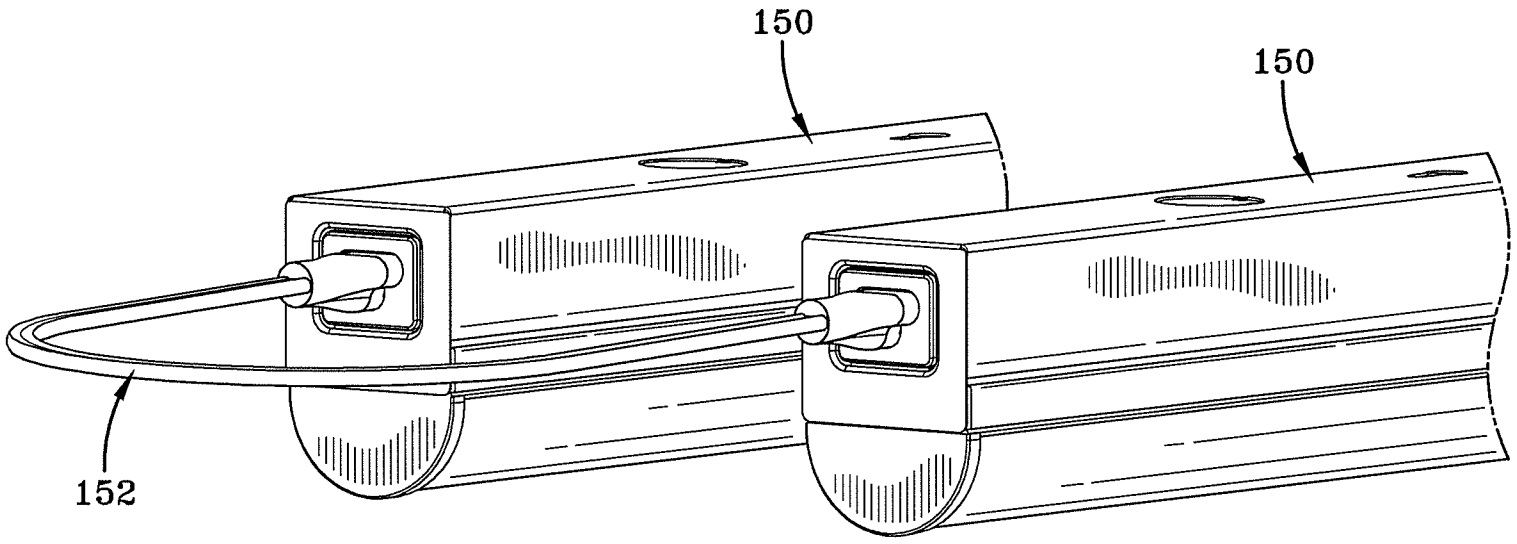
FIG. 10 is a perspective view of an LED string light system according to an embodiment of the invention incorporating a pair of LED strip light assemblies according to a preferred embodiment of the invention linked together according to another embodiment of the invention.

Referring to FIG. 10, a pair of respective LED strip light assemblies 150 is shown which are connected by a linking cable 152. A series of LED strip light assemblies 150 can be connected together for a virtual unlimited number of LED strip light assemblies 150 by means of sequential linking cables 152. A power cable would be required to connect an end of LED strip light assembly 150 to a power source.

Figure 11:
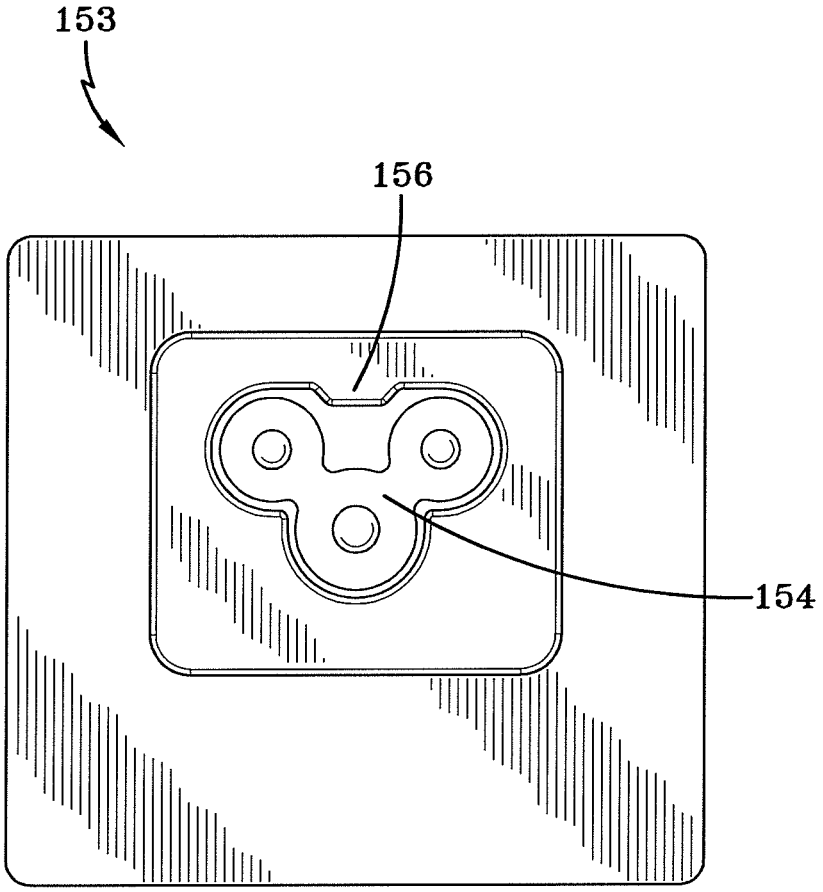
FIG. 11 is an end view of one of the LED strip light fixture of the type shown in FIG. 10 with an installed protective cap.

Referring to FIG. 11, an end view of an LED strip light fixture 153 is shown. A linking opening (discussed below) in which a linking plug (discussed below) is to be inserted should be protected when not in use. Therefore, a protective cap 154 having a trefoil configuration, which is the same configuration as that leading to the end connector opening, it is used to protect the end connector opening. This is shown in FIG. 11. Protective cap 154 has a depression 156 into which an implement can be inserted for removing protective cap 154 from the end connector opening.

Figure 12:
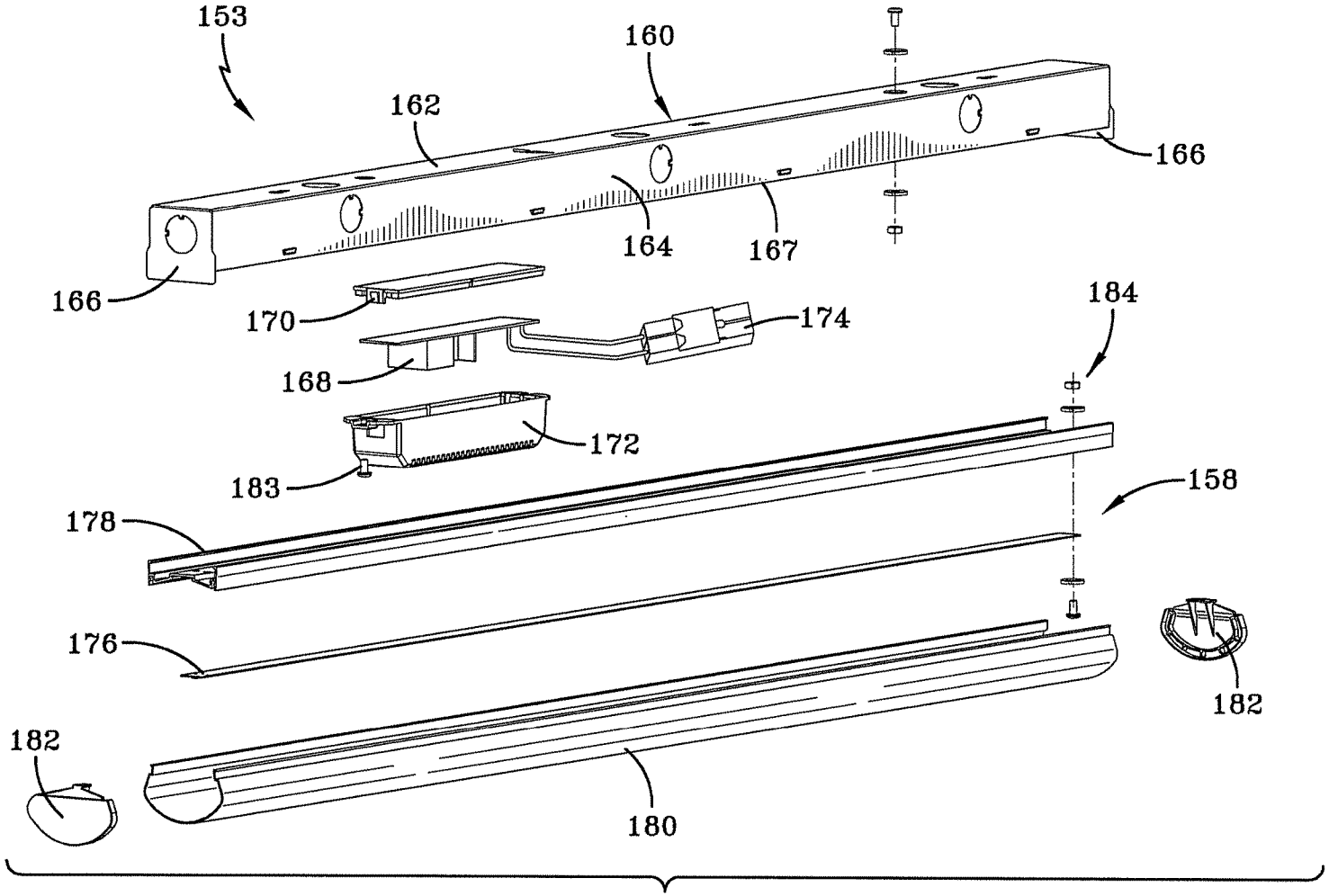
FIG. 12 is an exploded view of one of the LED strip light fixtures as incorporated in the assembly shown in FIG. 10.

An exploded view of one form of LED strip light fixture 153 is shown in FIG. 12. LED strip light fixture 153 includes a housing 160 which comprises a top piece 162 and a pair of parallel, opposing, and elongated side walls 164 with a pair of opposing end pieces 166 which are mounted across the coplanar parallel ends of top piece 162. Side walls 164 have elongated, side wall bottom edges 167.

LED strip light fixture 153 includes an LED strip light 158 which includes a driver 168 above which is a driver box bottom 170. Driver 168 fits inside a driver box top 172 and driver box bottom 170 to be enclosed therein. A power plug 174 is provided for attachment to driver 168 for transmitting electric power thereto.

An LED module 176 is an elongated member having a plurality of strips of LEDs included therein. A heat sink 178 which is of about the same length as LED module 176, and it is provided for absorbing the heat generated by LED module 176. Also attached to housing 160 is a diffuser 180 which receives LED module 176 and heat sink 178, and which is clipped to the bottom of housing 160. Diffuser 180 diffuses illumination from LED module 176 in a generally downward direction.

A pair of end covers 182 clip onto the ends of diffuser 180 to protect the interior of diffuser 180 and the parts that it encloses, from contaminants in the ambient air.

A screw assembly 183 is used for attaching driver box top with driver 168 and driver box bottom 170 to housing 160. Screw, washer and nut assembly attach the illumination components including diffuser 180, LED module 176 and heat sink 178 to housing 160.

Figure 13:
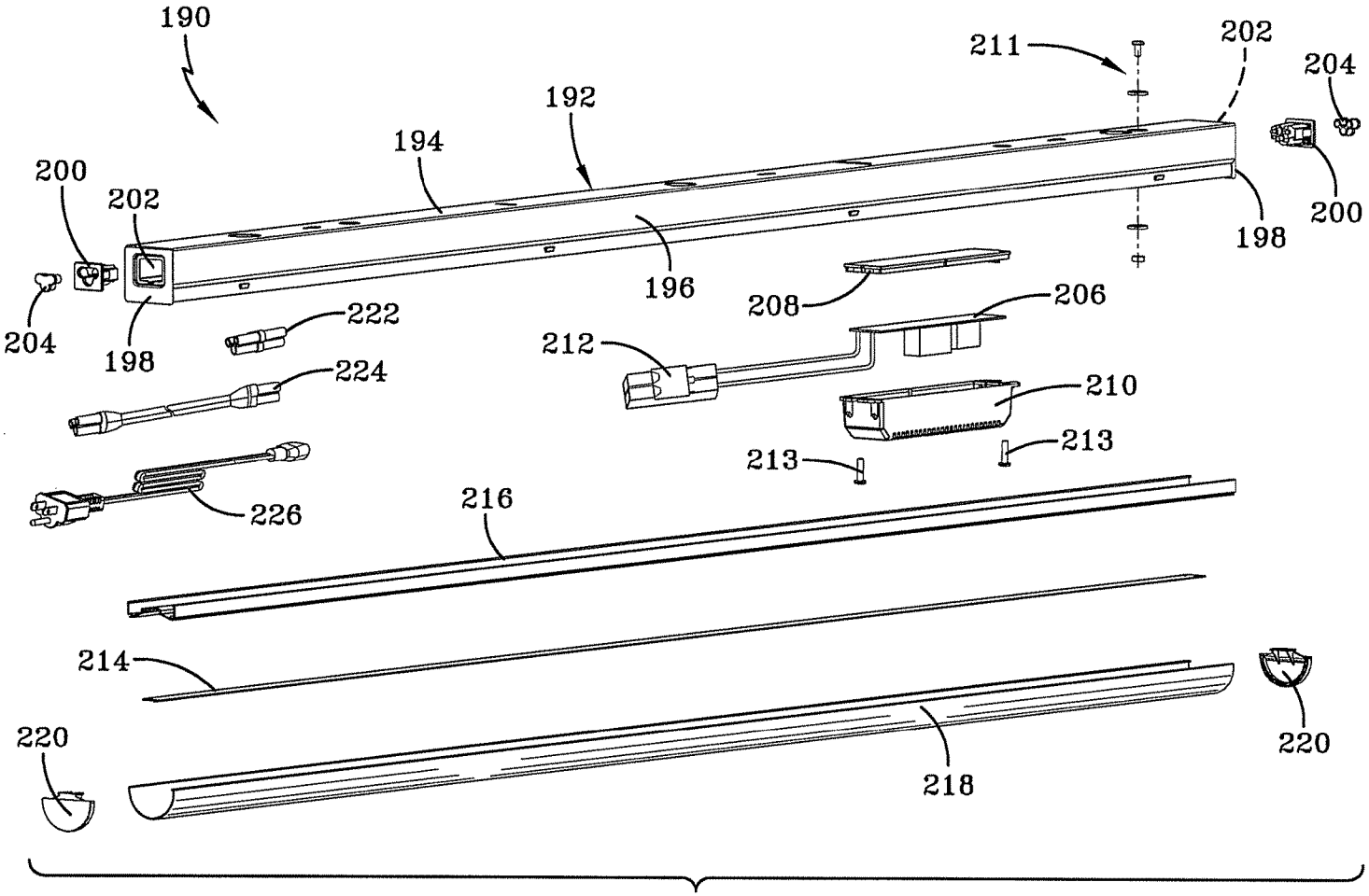
FIG. 13 is an exploded view of another version of an LED strip light fixture according to a preferred embodiment of the invention.

Another size of an LED strip light assembly is shown in FIG. 13. Referring to FIG. 13, an LED strip light assembly 190 is shown. LED strip light assembly 190 includes a housing 192 having a top wall 194 extending downwardly from its opposing parallel edges is a pair of side walls 196, to form three walls of a rectangular parallelepiped having an open bottom opposite top wall 194. Housing 192 has a pair of end pieces 198 which are disposed at the opposite ends of housing 192. Connecting seats 200 are disposed in apertures 202 in respective end pieces 198. Connecting seats 200 have a trefoil-shaped opening for receiving a linking plug, and electrical input plug or a protective cap 204 for the protection of the interior of connecting seat 200, when a plug is not installed therein. A linking cable or connecting cord 224 similar to linking cable 63 or a linking connector 222 similar to linking connector 53 discussed with respect to shop light assembly 1 are provided. Reference is made to the discussion regarding linking connector 53 for a description of linking connector 222. A power cable or power cord 226 is similar to power cable 61 is required when assembly 190 is to be turned on for illumination. Reference is made to the discussion of power cable 61 for the description of the components of the electric input plug and the outlet plug included in power cable 226. LED strip light assembly 190 includes an LED strip light fixture 191 with the foregoing components other than linking connector 222, linking cable 224 and power cord 226.

The following parts are those known from known strip light assemblies. These include a driver 206, a driver box bottom 208, a driver box top 210 and a screw assembly 211 for attaching driver box top 210 to driver box bottom 208 for enclosing driver 206. A power plug 212 is also provided for power for driver 206. Screws 213 attach driver box bottom 208 to driver box top 210 to enclose driver 206. Strip light 190 further includes an LED module 214, a heat sink 216, a diffuser 218 and a pair of opposing end covers 220.

Figure 14:
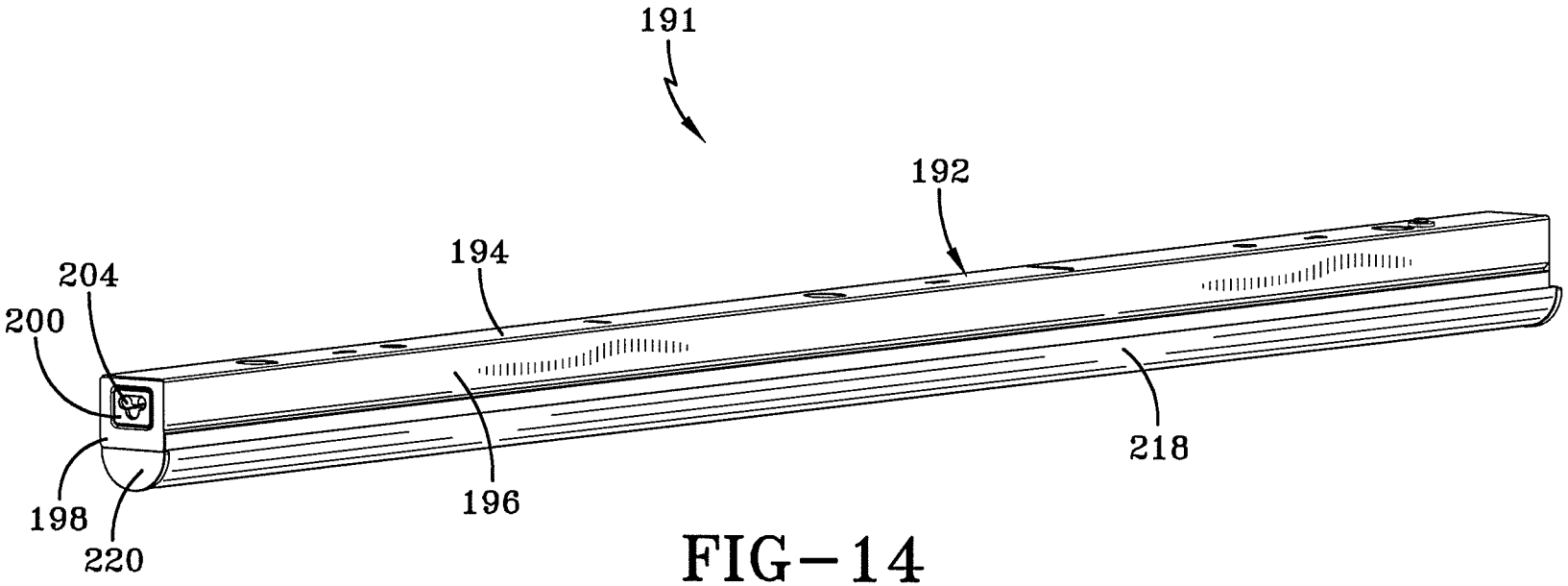
FIGS. 14-18 are respective perspective, top, front, end and bottom views of the subassembly of an LED strip light fixture including the housing, the diffuser, the end covers and connecting seats of the strip light assembly.

Drawings of the entire strip light assembly 190 are shown in FIGS. 14-18. FIG. 14 shows LED strip light fixture 191 in perspective form. Shown in FIG. 14 are housing 192 with top wall 194 and side wall 196, end piece 198 having inserted therein connecting seat 200 with protective cap 204. Located between end covers 214 is diffuser 218.

Figure 15:
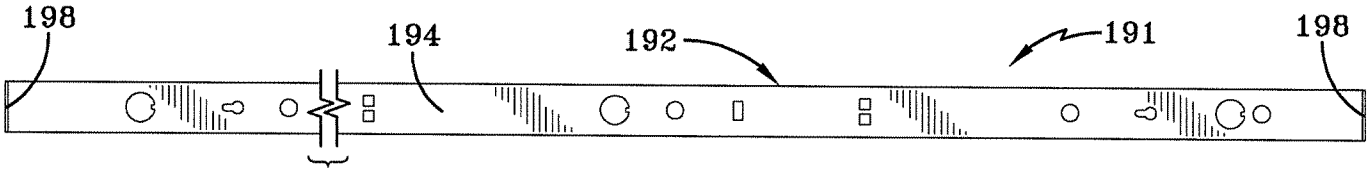
Figure 16:
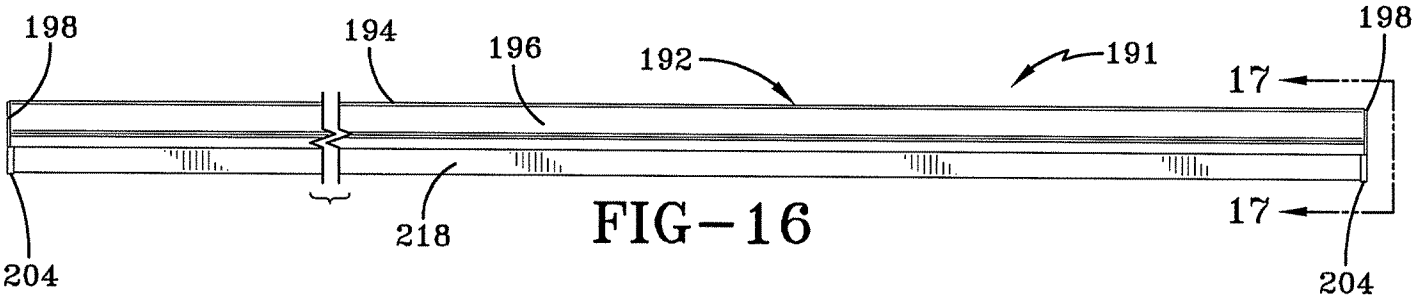
Figure 17:
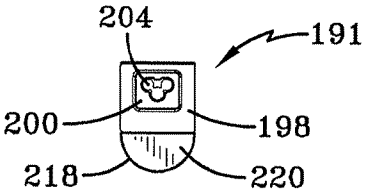
Figure 18:
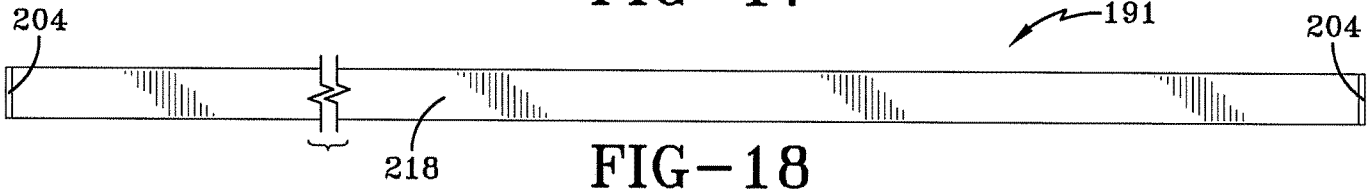

FIG. 15 shows a top view of strip light fixture 191 in which can be seen top wall 194 of housing 192. A front view of LED strip light fixture 191 is depicted in FIG. 16. Housing 192 is shown on which side wall 196 is visible. The lower portion of LED strip light fixture 191 is diffuser 218. The end view of LED light fixture 191 in inverted form is shown in FIG. 17. End cover 220 is shown above end piece 198 in which are located connecting seat 200 into which extends protective cap 204. Referring to FIG. 18, the bottom view of LED strip light fixture 191 shows diffuser 218 between protective caps 204.

Figure 19:
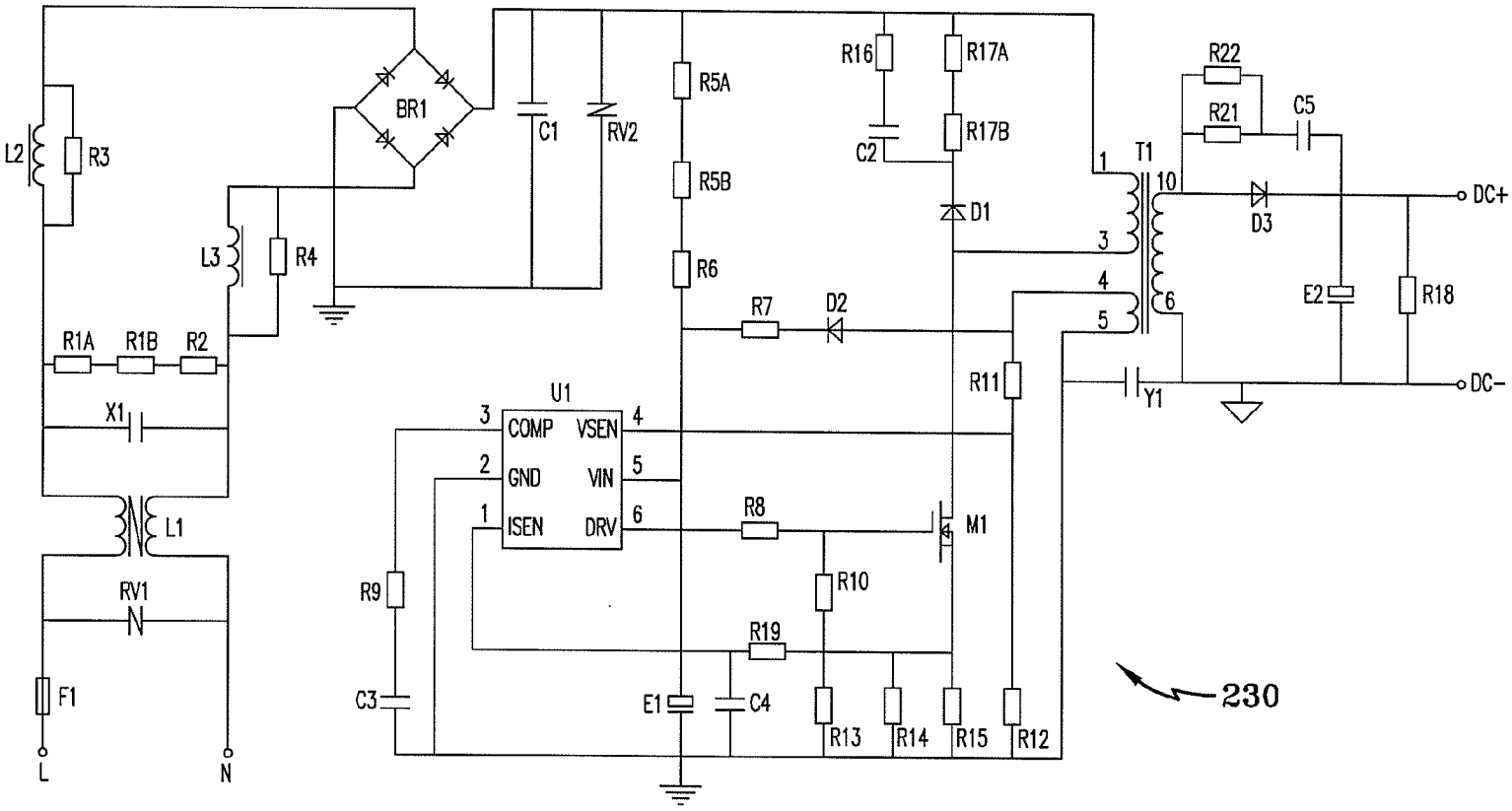
FIG. 19 is an electric circuit diagram of the electrical components included in the foregoing LED strip light fixture in the LED strip light assemblies shown in FIGS. 10-13.

Referring next to FIG. 19, a circuit 230 is shown for the electric circuitry of strip light assemblies 150 and 190. Circuit 230 includes inputs L and N, a fuse F1 connected in parallel with a voltage variator RV1, and the latter are connected to a variable inductor L1. These are connected to a circuit for output smoothing, which includes a capacitor X1, resistors R1A, R1B and R2, the latter of which are connected in series and in parallel with capacitor X1. Also included in the smoothing circuit are resistor R3 which is connected across inductor L2 and resistor R4 which is connected across inductor L3. Included in the smoothing circuit is a diode bridge BR1. BR1 is connected in parallel with a capacitor C1 and a variable capacitor RV2. Another circuit connected to the previously discussed circuits includes three resistors R5A, R5B and R6 which connected in series, and in parallel with a diode D2 and a resistor R7. Further in the latter circuit are a resistor R16 connected in series with a capacitor C2, connected in parallel with resistors R17A and R17B, the latter connected in series. A transformer T1 is connected across the latter circuit including diode D1 and another circuit having a positive direct current and negative direct current terminals. Lines 4 and 5 which are connected to transformer T1 run in parallel and resistors R11 and R12 are connected in line 4. Between the line connecting R11 and R12 is a line connected across a control circuit U1. A semiconductor control component M1 is connected in parallel with resistors R10 and R19, and in parallel with parallel conductors R13, R14 and R15 as well as capacitor C4.

The embodiments of the invention described above provide very useful and economical lighting systems which can be used to illuminate different areas according to their respective sizes and shapes. The respective LED light assemblies can be easily linked together by persons without needing any training to make these connections. With respect to a series of LED shop light fixtures, the LED shop light fixtures can be placed in virtually any space and pointed in any direction, linked together and plugged into a wall output. Similarly, LED strip light fixtures can be linked together and be connected to a power outlet with a power cord. The respective LED light units can be connected together by a linking cable of any length, and which is flexible so that the respective lighting units can face in virtually any direction. Similarly, the lighting units can be connected together by rigid connector to render lighting units to be in effect a single lighting unit having various lengths, with the individual components being individually operated.

The invention has been described in detail, with particular emphases on the preferred embodiments thereof, but variations and modifications may occur to those skilled in the art to which the invention pertains.

The invention claimed is:

1. An LED shop light system comprising:

an LED shop light assembly comprising:

a first linkable LED shop light fixture having opposite fixture end portions and comprising:

an LED shop light lamp having opposite LED shop light lamp end portions, said LED shop light lamp including:

an LED module comprising:

a printed circuit board; and an array of LEDs connected to said printed circuit board;

a driver for transmitting electric power to said LED module;

a diffuser for containing said LED module for diffusing light generated by said array of LEDs; and electrical connections in said respective LED shop light lamp end portions for cooperating with electrical transmitting lines;

a cover for holding said LED shop light lamp, said cover comprising:

a shade for partially surrounding said LED shop light lamp for preventing light from being transmitted therethrough, said shade having opposite shade end portions;

an end structure mounted to said shade at said respective shade end portions for receiving said respective LED shop light lamp end portions to mount said LED shop light lamp in said shade, and for permitting access of electrical transmitting lines to said electrical connections of said LED shop light lamp;

at least one additional linkable LED shop light assembly including a second linkable shop light fixture comprising another electrical connection for cooperating with said electrical connection of said first LED shop light lamp; and a linking device for cooperating with one of said electrical connections in each of said linkable LED shop light assemblies for electrically linking said linkable LED shop light assemblies together.

2. The LED shop light system according to claim 1 wherein said linking device is a linking cable.

3. The LED shop light system according to claim 1 wherein said linking device is a linking connector.

4. The LED shop light system according to claim 1 and further comprising:

a power cable comprising:

an insulated cable having opposing power cable ends;

an outlet plug at one of said power cable ends for insertion into a power socket; and an electrical input plug at the other of said power cable ends for insertion into one of said electrical connections on one of said LED shop light for transmitting electrical power to said linkable LED shop light fixtures.

5. The LED shop light system according to claim 1 wherein said linking device comprises at least one of:

a linking cable comprised of:

an insulated cable line having opposing cable ends; and linking plugs operatively attached to said respective cable ends for electrical connection to said electrical connections on a pair of linkable LED shop light fixtures to electrically connect said pair of linkable LED shop light fixtures together in a series relationships; and a rigid lamp connector for electrical connection of said electrical connections on a pair of linkable LED shop light fixtures to electrically connect said pair of linkable LED shop light fixtures together.

6. The LED shop light system according to claim 1 wherein said respective LED shop light fixtures have switches for selectively turning said respective LED shop light lamps on and off without affecting the remaining LED shop light lamps.

7. The LED shop light system according to claim 1 wherein:

said end structure each comprise an LED lamp electrically contacting structure for providing an electrical contact to the electrical connections of said LED shop light lamp to transmit electrical current to said LED shop light lamp; and said linking device comprises a linking electrically contacting structure for cooperating with said LED lamp electrically contacting structure to enable the transmission of electrical current to said LED shop light lamp.

8. The LED shop light system according to claim 3 wherein said linking connector is rigid.

9. The LED shop light system according to claim 7 wherein said electrical connections are a set of electrical wires, and wherein said LED lamp electrically contacting structure are a set of electrically insulated tubes having electrical conducting sleeves that are connected to said appropriate wires for transmitting electrical current thereto; and said linking electrically contacting structure are a set of insulating tubes having electrical conducting sleeves for receiving said respective electrically insulated tubes with electrical contact with said electrical conducting sleeves connected to said appropriate wires to enable transmission of electrical current from said lining electrically contacting structure to said LED lamp electrically contacting structure.

10. An LED shop light assembly comprising:

a linkable LED shop light fixture comprising:

an LED shop light lamp having opposite LED shop light end portions, said LED shop light lamp including:

an LED module comprising:

a printed circuit board; and an array of LEDs connected to said printed circuit board;

a driver for transmitting electrical power to said LED module;

a diffuser for containing said LED module and said array of LEDs for diffusing light generated by said array of LEDs; and electrical connections in said respective LED shop light lamp end portions for cooperating with electrical transmitting lines;

a cover for holding said LED shop light lamp, said cover comprising:

a shade for partially surrounding said LED shop light lamp for preventing light from being transmitted therethrough, said shade having opposite shade end portions;

a pair of end caps attached to said shade at said respective shade end portions for protecting said respective LED shop light lamp end portions to mount said LED shop light lamp in said shade, and for permitting access of electrical transmitting lines to said electrical connections of said LED shop light lamp; and a linking connector for cooperating with one of said electrical connections for electrically connecting said linkable LED shop light fixture to another linkable LED shop light fixture.

11. A linkable, elongated LED light assembly comprising:

an elongated linkable LED light fixture including:

an elongated housing, said elongated housing comprising:

an elongated top wall having opposing top wall end portions and opposing elongated sides;

opposing elongated side walls extending from said elongated opposing sides of said elongated top wall, said opposing elongated side walls having opposing side wall end portions coplanar with said respective top wall end portions to define opposing housing end portions; and opposing end members extending across and connected to said respective opposing housing end portions, said opposing end members having end connectors for receiving linking plugs and electrical input plugs, said elongated top wall, said opposing elongated side walls and said opposing end members defining an elongated cavity;

a linkable, elongated LED lamp having LED lamp end portions; and an elongated LED module disposed in and extending lengthwise in said elongated cavity, said elongated LED module including:

a printed circuit board; and an array of LEDs connected to said printed circuit board;

an elongated diffuser for diffusing illumination located in said elongated cavity;

an elongated heat sink disposed in and extending lengthwise in said elongated diffuser; and a driver disposed in said elongated cavity, said driver being electrically connected to said elongated LED module;

said elongated LED module and said driver being electrically connectable as part of an electric circuit;

a power cable having opposing power cable ends, said power cable having an outlet plug for insertion into a power receptacle and an electrical input plug for insertion into one of said end connectors for providing electrical power to said driver and said elongated LED module;

at least one of a linking cable having linking plugs for cooperating with said end connectors for electrically connecting two of said linkable elongated LED light fixtures together, said linkable elongated LED light fixtures being actuable to turn selectively said LED lamps on and off individually or together, and a linking connector having opposing prong receptacles at opposing ends of said linking connector for receiving in said opposing prong receptacles, LED lamp prongs to electrically link said linkable LED light assemblies together; and said end connectors located at said LED lamp end portions for receiving a selected one of the group consisting of said linking plug.

12. The linkable elongated LED assembly according to claim 11 wherein said linkable, elongated LED lamp assembly is a linkable, elongated LED shop light assembly, and wherein:

said elongated top wall has a rectangular configuration;

said opposing elongated side walls are identical with each other and have a rectangular configuration; and said opposing end members are identical end piece members; and wherein said linkable, elongated LED lamp is a linkable, elongated LED shop lamp comprising:

one or more strings of LEDs, each of said one or more strings of LEDs including LEDs electrically connected to each other in parallel connections, and wherein said driver is electrically connected to each string of LEDs; and a circuit switch having a closed position for closing said electrical circuit and an open position for opening said electrical circuit;

wherein said linking plug of said linking cable comprises an equiangularly-spaced lamp prong receptacles;

wherein said linking plugs of said linking cable each comprise an equiangularly-spaced lamp prong receptacles; and wherein said end connectors selectively receive a selected one of said equiangularly-spaced lamp prong receptacles of said linking plug of said power cable and said equiangularly-spaced linking lamp prong receptacles of said linking plug of said linking cable, to respectively electrically connect said linking, elongated LED shop light lamp to a power supply and to a second linkable, elongated LED shop light lamp, or to electrically connect two linkable, elongated LED shop light lamps in separate LED shop light lamp assemblies together.

13. The linkable elongated LED assembly according to claim 11 wherein said elongated LED module is rated for a life of at least 50,000 hours, at least 900 lumens and powered by at least 10 watts.

14. The linkable elongated LED light assembly according to claims 11 wherein said linkable, elongated LED light assembly is a linkable, elongated LED strip light assembly, and wherein:

said elongated top wall of said elongated housing has a rectangular configuration;

said opposing elongated side walls respectively have a rectangular configuration, and elongated side wall bottom edges distal said top wall;

said elongated top wall and said opposing elongated side walls form three walls of an elongated, rectangular parallelepiped having an elongated, open bottom portion opposite said elongated, top wall;

said opposing end members are identical and comprise end pieces with apertures centrally located in said respective end pieces, and connecting pieces for receiving a selected one of said power cable linking plug and said linking cable linking plug;

said array of LEDs comprises:

a plurality of strips of LEDs;

said linkable, elongated LED lamp further comprises:

a driver box bottom and a driver box top for enclosing said driver;

said elongated diffuser is an elongated longitudinal section of a hollow cylinder having parallel, elongated diffuser edges, said diffuser edges engaging said elongated, side wall bottom edges of said housing, with said diffuser extending outwardly from said housing.

15. The linkable, elongated LED light assembly according to claim 14 wherein said elongated LED module is rated for at least 1350 lumens and powered by at least 10 watts.

16. A linkable, elongated LED shop light assembly having opposite ends and comprising:

a housing assembly comprising at least one elongated LED shop light, each of said at least one elongated LED shop lights comprising:

a three sided shade including:

a rectangular top wall including a relatively short width with opposing straight parallel end edges and parallel opposing straight side edges, said top wall having a set of chain holding holes for receiving the end of respective support chains for holding an LED shop light for suspending the LED shop light from an upper support;

a pair of identical opposing rectangular side walls having a first pair of opposing parallel side edges connected to said opposing straight parallel end edges of said rectangular top wall, and a second pair of opposing parallel side edges spaced from said first pair of opposing parallel side edges, said rectangular top wall and said pair of identical opposing rectangular side walls forming a three sided cavity having opposing end edges, each end edge having a flat upper edge connecting two, opposing parallel side edges to form a respective open end;

a pair of opposing identical rectangular side flange walls each having a first pair of opposing parallel elongated edges connected to said second pair of opposing parallel side edges of said side walls, and a second pair of opposing parallel elongated free edges, said pair of opposing identical rectangular side flange walls being inclined by equal amounts from said rectangular side walls, said first pair of opposing parallel elongated edges being proximal said top wall and said second pair of opposing, parallel elongated free edges being distal said top wall; and a pair of opposing identical end piece caps, each end piece cap comprising an upper flat plate dimensioned to fit against an underside of said rectangular top wall, and an end piece cover extending downwardly from said upper flat plate to close the respective open ends of said three sided cavity, said end piece cover having an LED shop light assembly end for covering the respective end portions of an elongated LED shop light lamp installed in said end piece cover;

an elongated LED shop light lamp having opposite end portions and a longitudinal axis, said elongated LED shop light lamp comprising:

an elongated module including:

at least two strings of LEDs, each string of LEDs including LEDs electrically connected to each other in parallel;

a driver operatively connected to said string of LEDs and electrically connectable to a power source;

electrical leads connectable to said elongated LED module;

said at least two strings of LEDs and said driver being electrically connectable as part of an electrical circuit; and a circuit switch having a closed position for closing said electrical circuit and a closed position for closing said electrical circuit, a heat sink spaced from and extending along said elongated LED module for absorbing heat generated by said strings of LEDs;

an elongated diffuser for partially surrounding said elongated LED module for diffusing illumination emitted by said LEDs;

end connectors at opposite end portions of said elongated LED shop light lamp, said end connectors each having three equiangularly spaced parallel prongs; and a pull chain operatively connected to said circuit switch for manually operating said circuit switch;

a power cable comprising:

an electricity transmitting line having opposite line ends;

an outlet plug operatively connected to one of said line ends, said outlet plug having plug prongs for insertion into an electrical power outlet; and an electrical linking plug operatively connected to the one of said line ends, said electrical linking plug having three equiangularly-spaced power cable connector prong receptacles corresponding to said three equiangularly-spaced prongs of said end connectors of said LED shop light lamp and arranged for simultaneous reception of said respective prongs for providing electrical power to said LED shop light lamp;

a linking cable for selectively electrically linking a pair of said linkable elongated LED shop light lamps together, said linking cable comprising:

a linking cable electrical line having opposite linking cable electrical line ends; and identical linking plugs electrically connected to said linking cable electrical line, said linking plugs comprising three equiangularly-spaced LED shop light lamp prong receptacles corresponding to said three equiangularly-spaced LED shop light lamp prongs and arranged for simultaneous insertion over said respective LED shop light lamp prongs for receiving said respective LED shop light lamp prongs into said LED shop light lamp prong receptacles;

a rigid lamp connector having opposing prong receptacles at ends of said rigid lamp connector, said rigid lamp connector connecting comprising at each of said prong receptacles, three equally-spaced LED lamp prong receptacles for receiving at each of said LED lamp prong receptacles, reception of LED lamp prongs to electrically link said linkage elongated LED shop light assemblies; and an end cap having opposing end cap ends, said end cap comprising:

three equiangularly spaced LED lamp prong chambers for providing access to said end connectors of said elongated LED shop light; and a closed end piece for selectively preventing access to said end connectors of said elongated LED lamps;

wherein said linkable elongated LED shop light assemblies when electrically linked together are selectively actuable by pulling said respective pull chains to turn the respective LED lamps on or off independently of the remaining linkable, elongated LED shop light assemblies.

17. An elongated LED light assembly comprising:

an elongated linkable LED light fixture including:

an elongated housing, said elongated housing comprising:

an elongated top wall having opposing top wall end portions and opposing elongated sides;

opposing elongated side walls extending from said elongated opposing sides of said elongated top wall, said opposing elongated side walls having opposing side wall end portions coplanar with said respective top wall end portions to define opposing housing end portions; and opposing end members extending across and connected to said respective opposing housing end portions, said opposing end members having electrical connector openings for receiving linking plugs and electrical input plugs, said elongated top wall, said opposing elongated side walls and said opposing end members defining an elongated cavity;

an LED lamp comprising:

a printed circuit board being part of an electric circuit;

an array of LEDs connected to said printed circuit board; and an elongated diffuser for diffusing illumination located in said elongated cavity;

end connectors located at said LED lamp end portions for receiving a selected one of the group consisting of a linking plug and an electrical input plug to provide electrical power to said printed circuit;

a power cable having opposing power cable ends, said power cable having an outlet plug for insertion into a power receptacle and an electrical input plug for insertion into one of said electrical connector openings for providing electrical power to said printed circuit; and at least one of a linking cable having linking plugs for cooperating with said end connectors for electrically connecting two of said linkable elongated LED light fixtures together, said linkable elongated LED light fixtures being actuable to turn selectively said LED lamps on and off individually or together; and a linking connector for cooperating with one of said end connectors of a pair of said elongated LED light assemblies for electrically connecting said elongated LED light assemblies together.

18. An LED shop light system comprising:

an LED shop light assembly comprising:

a first linkable LED shop light fixture having fixture end portions and comprising:

an LED shop light lamp having LED shop light lamp end portions, said LED shop light lamp including:

an LED module comprising:

a printed circuit board; and an array of LEDs connected to said printed circuit board;

a driver for transmitting electric power to said LED module; and electrical connections in said respective LED shop light lamp end portions for cooperating with electrical transmitting lines, said electrical connections comprising a set of electrical wires;

wherein said LED shop light end portions each comprise:

an end structure, each end structure including an LED lamp electrically contacting structure for providing an electrical contact to the electrical connections of said LED shop light lamp to transmit electrical current to said LED shop light lamp; and at least one additional linkable LED shop light assembly including a second linkable shop light fixture comprising another electrical connection for cooperating with said electrical connection of said first LED shop light lamp; and a linking device for cooperating with one of said electrical connections in each of said linkable LED shop light assemblies for electrically linking said linkable LED shop light assemblies together, said linking device including a linking electrically contacting structure for cooperating with said LED lamp electrically contacting structure to enable the transmission of electrical current to said LED shop light lamp, said LED lamp electrically contacting structure comprising a set of electrically insulated tubes having electrical conducting sleeves that are connected to said appropriate wires for transmitting electrical current thereto; and said linking electrically contacting structure are a set of insulating tubes have electrical conducting sleeves for receiving said respective electrically insulated tubes with electrical contact with said electrical conducting sleeves connected to said appropriate wires to enable transmission of electrical current from said linking electrically contacting structure to said LED lamp electrically contacting structure.

19. The LED shop light system according to claim 18 wherein said linking device comprises at least one of the group consisting of a linking cable and a linking connector.

20. The LED shop light system according to claim 18 and further comprising:

a power cable comprising:

an insulated cable having opposing power cable ends;

an outlet plug at one of said power cable ends for insertion into a power socket; and an electrical input plug at the other of said power cable ends for insertion into one of said electrical connections on one of said LED shop light for transmitting electrical power to said linkable LED shop light fixtures.

21. The LED shop light system according to claim 18 wherein said respective LED shop light fixtures have switches for selectively turning said respective LED shop light lamps on and off without turning the remaining LED shop light lamps on or off.

* * * * *